US005327196A

United States Patent [19]

Kato et al.

[11] Patent Number: 5,327,196

[45] Date of Patent: Jul. 5, 1994

[54] IMAGE FORMING METHOD

[75] Inventors: Shinji Kato, Kawasaki; Yasushi Koichi, Yamato; Shin Hasegawa, Kawasaki, all of Japan

[73] Assignee: Ricoh Company, Ltd., Tokyo, Japan

[21] Appl. No.: 981,410

[22] Filed: Nov. 25, 1992

[30] Foreign Application Priority Data

Nov. 25, 1991 [JP] Japan ..... 3-335649
Feb. 17, 1992 [JP] Japan ..... 4-061175
Sep. 11, 1992 [JP] Japan ..... 4-269748

[51] Int. Cl.[5] ..... G03G 15/00

[52] U.S. Cl. ..... 355/208; 118/689; 355/246

[58] Field of Search ..... 355/246, 203-209; 118/689, 690, 688, 691, 657, 658

[56] References Cited

U.S. PATENT DOCUMENTS 4,468,112 8/1984 Suzuki et al. ..... 118/689 X
4,648,702 3/1987 Goto ..... 118/691 X
4,883,019 11/1989 Menjo et al. ..... 118/691
4,974,024 11/1990 Bares et al. ..... 355/246

*Primary Examiner*—A. T. Grimley
*Assistant Examiner*—T. Dang
*Attorney, Agent, or Firm*—Oblon, Spivak, McClelland, Maier & Neustadt

[57] ABSTRACT

In an image forming method using an electrophotographic process, an amount of toner to be supplemented for maintaining a desired image density is estimated in response to input data which are a ratio of reflection densities produced by an optical sensor responsive to a pattern for control and an estimated toner consumption signal. Toner supplement control is executed on the basis of the result of estimation. The method sharply responds to a change in environment due to aging and a change in the kind of documents to thereby insure stable image density, compared to a conventional method relaying on an optical sensor or a toner sensor.

17 Claims, 37 Drawing Sheets (INVENTION)

| Fig. 14A | Fig. 14B |
|---|---|

Fig. 15A
Fig. 15
| Fig. 15A | Fig. 15B |
|---|---|
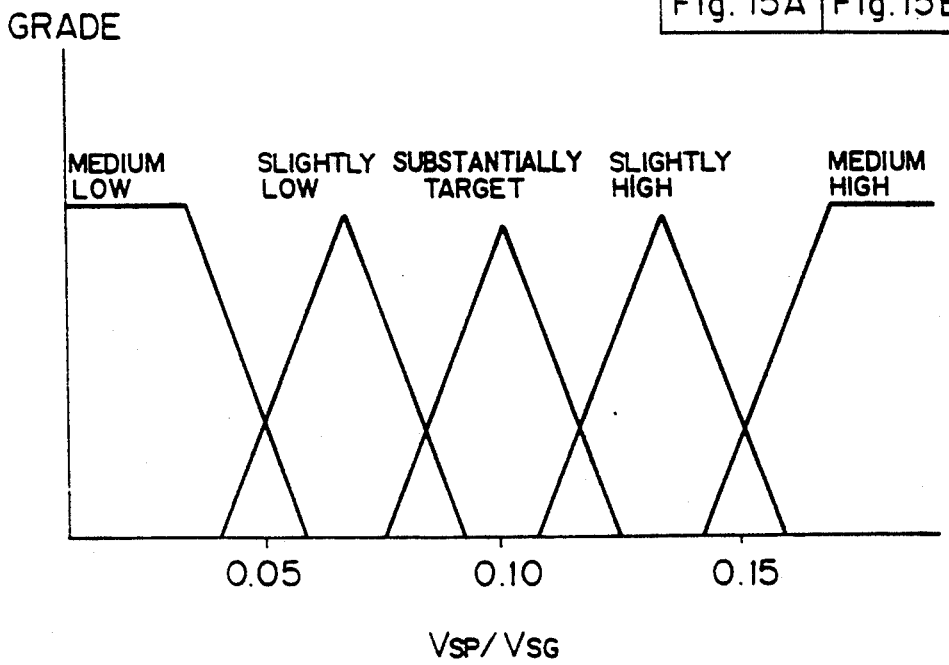
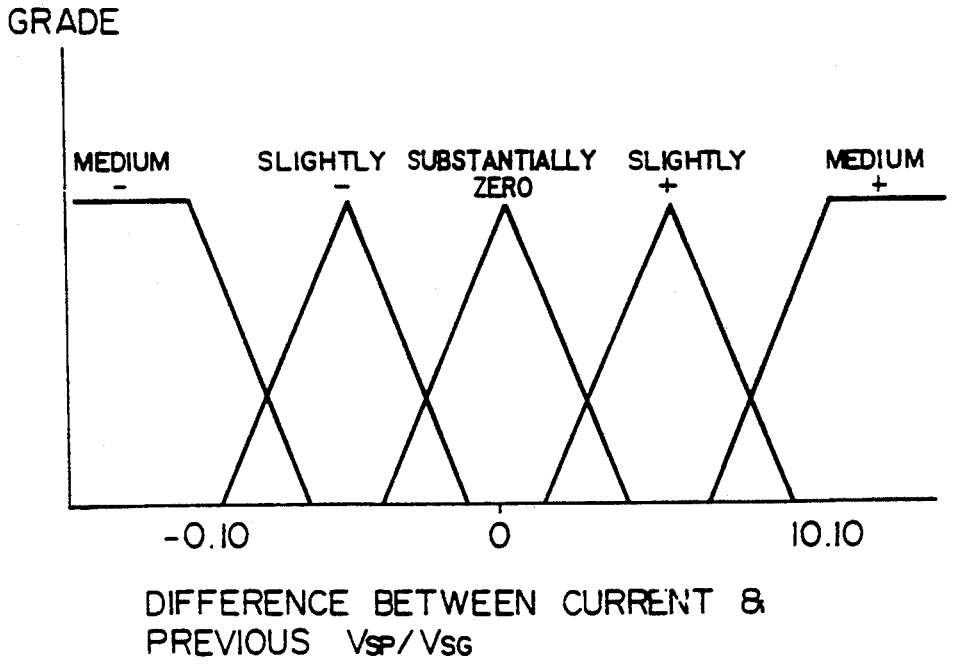

| Fig. 17A | Fig. 17B |
|---|---|

Fig. 18A
Fig. 18
| Fig. 18A | Fig. 18B |
|---|---|
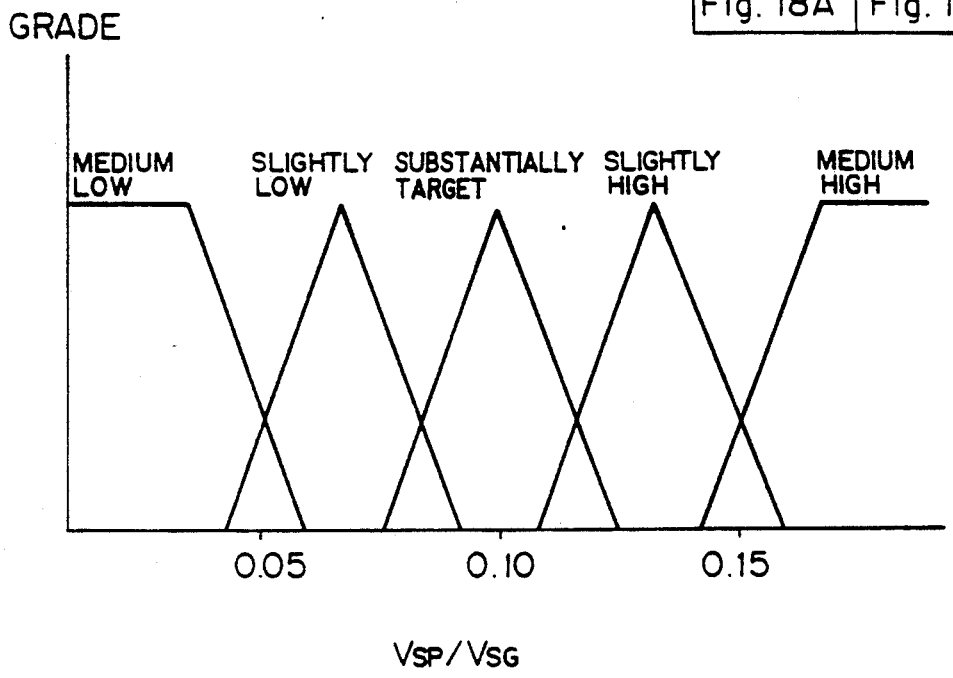
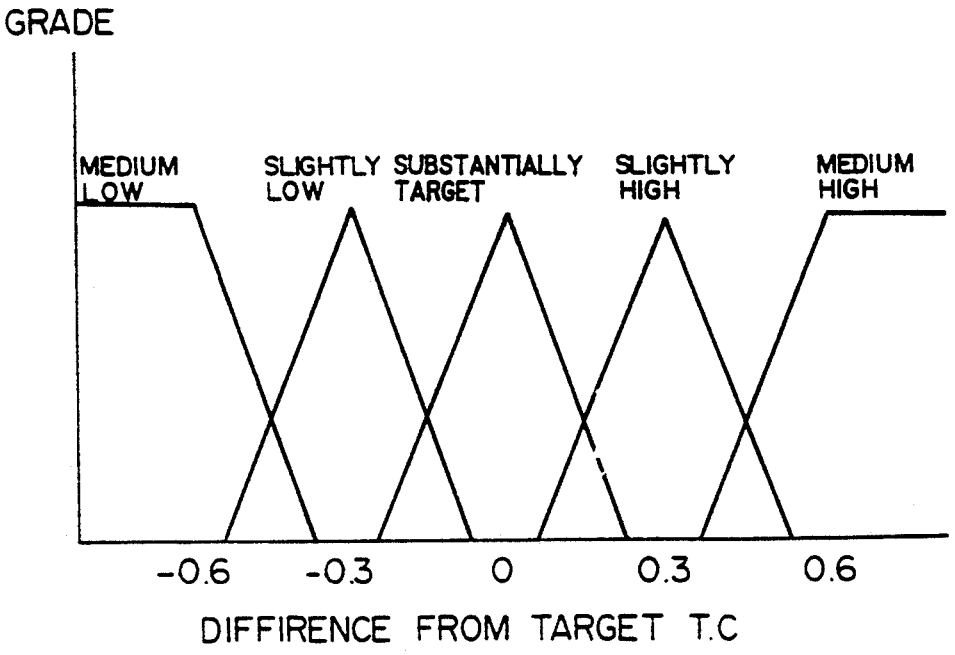

| Fig. 20A | Fig. 20B |
|---|---|

| Fig. 21A |
| --- |
| Fig. 21B |

(INVENTION)

IMAGE FORMING METHOD

BACKGROUND OF THE INVENTION

The present invention relates to an image forming method capable of controlling the recording density of, for example, an electrophotographic apparatus and, more particularly, to an image forming method which insures adequate image formation at all times.

In an electrophotographic image forming apparatus, a latent image is electrostatically formed on an image carrier by a predetermined method and then developed by a toner fed from a developing unit. Usually, the toner is charged to polarity opposite to that of the latent image so as to be electrostatically deposited on the latent image. To charge the toner to the above-mentioned polarity, use is often made of a two component type developer, i.e., a mixture of toner and carrier. As the toner and carrier of this type of developer are mixed and agitated together, the toner is charged by friction. Development using the two component developer can charge the toner to a sufficient degree. However, control for maintaining the toner concentration of the developer, i.e., the image density constant is the prerequisite since only the toner is consumed by repetitive development. To meet this requirement, it has been customary to measure the toner concentration of the developer and control the supplement of toner on the basis of the result of measurement.

To measure the toner concentration of the developer, an indirect and a direct method are available. The indirect method forms an electrostatic latent image of a particular pattern or reference pattern on a photoconductive element, develops it, and then photoelectrically measures the density of the developed image by an optical sensor. The direct method measures the weight or permeability of the developer by a toner sensor.

The conventional image forming method starts supplementing the toner only after the toner concentration has been lowered. This brings about a problem that when documents of the kind consuming a great amount of toner are continuously reproduced, a supplement sharply changes the toner concentration, making it difficult to maintain the toner concentration stable.

Another problem is that the conventional method does not take account of the time lag between a toner supplement and an increase in toner concentration. Hence, the toner concentration varies over a noticeable range, i.e., the control accuracy is not satisfactory.

Still another problem is that the amount of toner to be consumed between consecutive patterns for control is noticeably effected by the pixel density of documents, varying environment and so forth, preventing an adequate amount of toner matching the toner consumption from being supplemented. At this instant, a change in the pixel density of documents between consecutive patterns for control, i.e., a change in the amount of toner consumption disturbs a feedback system associated with the optical sensor. To enhance accuracy of toner concentration, the number of times that the pattern for control is formed and, therefore, the amount of feedback data may be increased. This, however, aggravates the consumption of toner as well as the load acting on a cleaning unit.

Japanese Patent Laid-Open Publication No. 33704/1989 discloses an image forming method using first sensing means for determining an amount of toner consumed for reproduction by counting image form signals, and second means for determining an amount of toner scattered around on the basis of the operation time of the developing roller. Based on such amounts of toner consumption, this method supplies a toner to maintain the concentration constant. However, the relation between image form signals and amounts of toner consumption is not constant since it is influenced by changes in the charging ability of the carrier ascribable to the deterioration of the developer due to aging. It follows that the ability of the developing unit changes and makes it difficult to insure an ideal image quality or toner concentration in matching relation to the varying conditions.

Generally, regarding the two component developer for electrophotography, the charging ability of the carrier decreases due to the degradation of the developer ascribed to aging. In addition, the degree of charge accumulation and, therefore, Q/M increases in a low temperature, low humidity environment. By contrast, in a high temperature, high humidity environment, Q/M decreases since the degree of charge leak increases. It has ben customary to determine a control value by considering the influence of only one or two factors separately despite that many factors effect Q/M in combination, i.e., despite that an optimum control value has to be determined in consideration of multiple information to which the target is susceptible.

In addition, with the conventional method, it is impossible to form many patterns for control when it comes to a high speed machine which is severely restricted in respect of time. This, coupled with the fact that the control processing has to be executed at high speed, obstructs accurate control.

SUMMARY OF THE INVENTION

It is, therefore, an object of the present invention to provide an image forming method which responds to changes in environmental conditions and the kind of documents more sharply than the conventional one using an optical sensor or a toner sensor, thereby insuring stable image density.

It is another object of the present invention to provide an image forming method which reduces, without degrading control accuracy, the number of times that a pattern for control has to be formed, thereby reducing wasteful toner consumption ascribable to such a pattern, the load on a cleaning unit, and the fall of copying speed.

It is another object of the present invention to provide an image forming method capable of maintaining a target image density even when a great amount of toner is continuously consumed and a great amount of toner has to be supplemented, e.g., when black solid images are continuously formed.

It is another object of the present invention to provide an image forming method capable of performing accurate control even when the time available for control is severely limited.

In accordance with the present invention, in an image forming method using an electrophotographic process, an amount of toner to be supplemented for maintaining a desired image density is estimated in response to input data which are a ratio of reflection densities produced by an optical sensor responsive to a pattern for control and an estimated toner consumption signal, and toner supplement control is executed on the basis of the result of estimation.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a conventional image forming method of the kind using a photosensor, or P sensor as referred to hereinafter, as an optical sensor will be described specifically.

Figure 23:
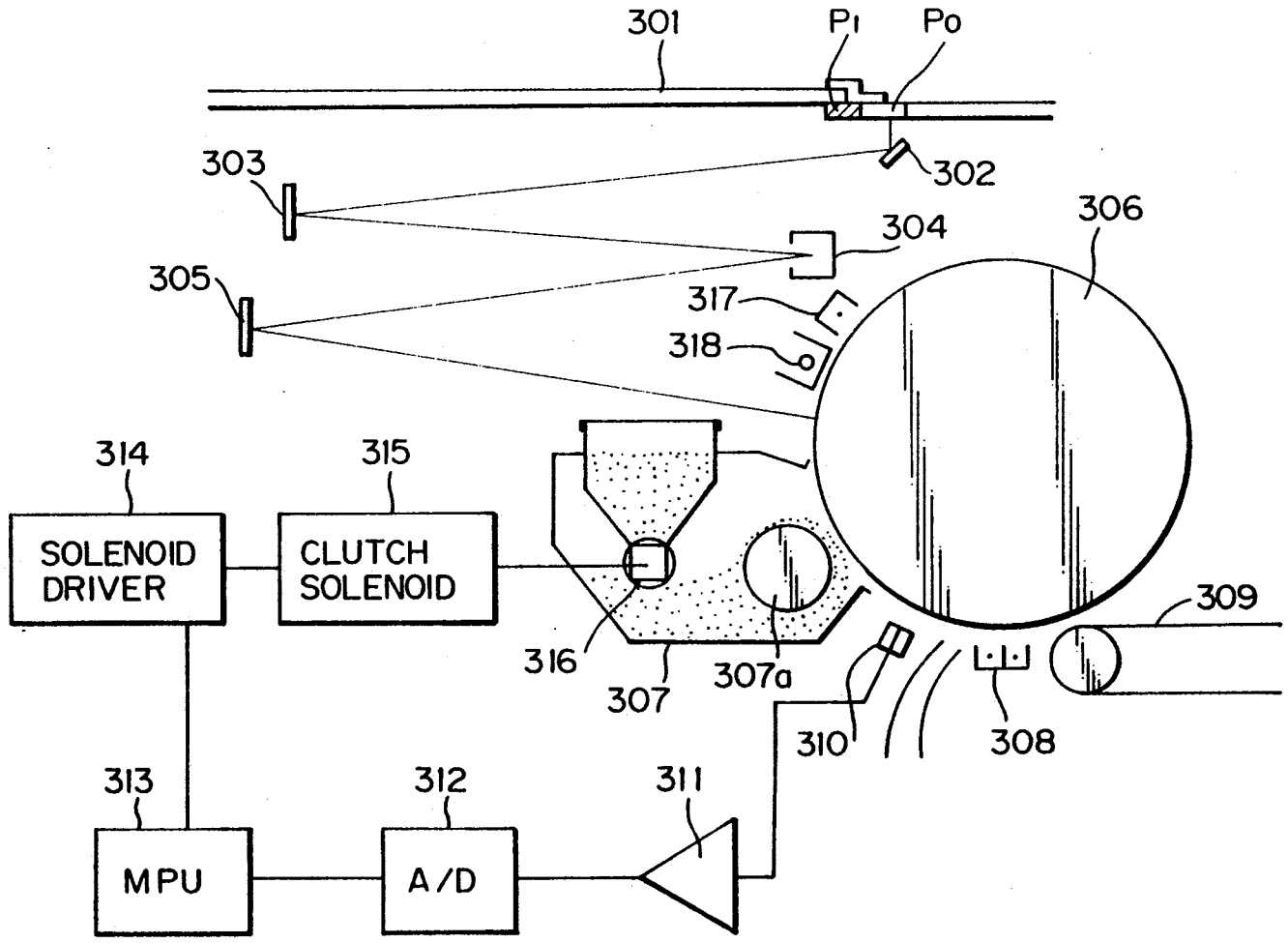
Fig. 23 PRIOR ART
FIG. 23 shows a copier implemented with a conventional image forming method.

Referring to FIG. 23, a copier implemented with the conventional image forming method is shown and includes glass platen 301. An image representative of a document, not shown, laid on the glass platen 301 is projected onto the surface of a photoconductive drum 306 via a first mirror 302, a second mirror 303, an in-mirror lens 304, and a third mirror 305. As the drum 306 is rotated (counterclockwise in the figure), the mirrors 302 and 303 are moved to the left in synchronism with the rotation of the drum 306 and at a predetermined speed ratio. A developing unit 307 has a developing roller **307*a* on which a developer (mixture of toner and carrier) is deposited. A latent image electrostatically formed on the drum 306 is developed by the developer carried on the developing roller 307*a*. The resulting toner image is transferred to a recording medium, e.g., a paper by a transfer charger 308. The paper carrying the toner image thereon is transported to a fixing station, not shown, by a separation belt 309**.

A white pattern $P_0$ and a black pattern $P_1$ are located in the visual field for image projection at the home position of the first mirror 302, as illustrated. When the mirror 302 is moved to the left for scanning the document, electrostatic latent images representative of the white pattern $P_0$ and black pattern $P_1$ are formed on the drum 30 one after another. A photosensor or P sensor 310 is located between the developing unit 307 and the transfer charger 308 for sensing the toner concentration of the developer deposited on the drum 306. The output of the P. sensor 310 is amplified and shaped by an amplifier 311, digitized by an analog-to-digital converter (ADC) 312, and then fed to a microprocessor (MPU) 318. In response, the MPU 313 calculates a density ratio ($V_{SP}/V_{SG}$) of the two toner images associated with the white pattern $P_0$ and black pattern $P_1$, respectively, determines an amount of supplementary toner based on the ratio, and then continuously feeds a solenoid drive command to a solenoid driver 314 for a period of time matching the amount of toner to supplement. In response, the solenoid driver 314 energizes a clutch solenoid 315. As a result, a roller 316 is rotated to feed a toner from a hopper to the developing unit 307. Further included in the apparatus are a main charger 317 for uniformly charging the drum 306, and an erase lamp 318 for dissipating the charge deposited on the portions of the charged surface of the drum 306 where the white pattern $P_0$ and black pattern $P_1$ are projected. The erase lamp 318 is selectively turned on such that the latent images associated with the two patterns $P_0$ and $P_1$ are formed on the drum 306 once per ten copies. The P sensor 310 senses the resulting toner concentrations.

Figure 24:
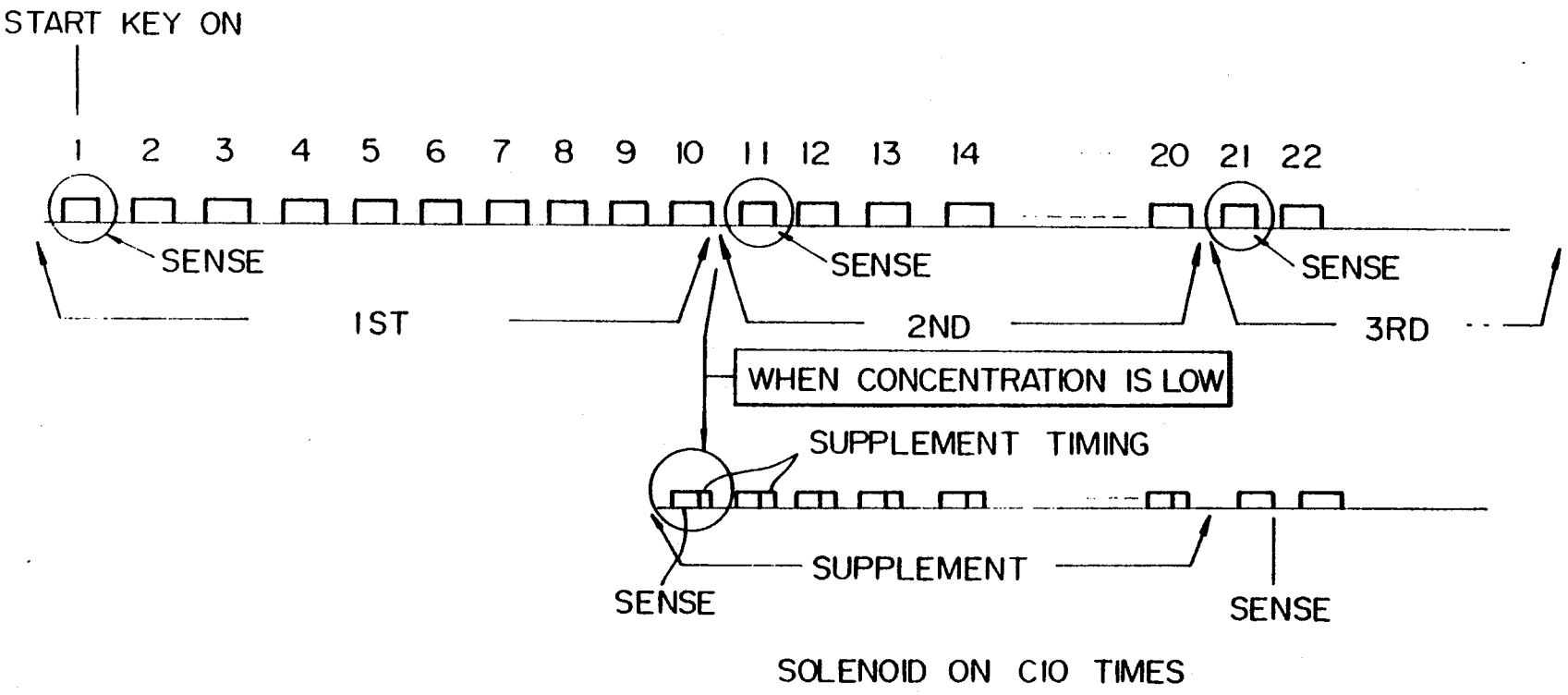
Fig. 24 PRIOR ART
FIGS. 24, 25 and 26 show control particular to the conventional method.

A reference will be made to FIGS. 24, 25 and 26A–26C for describing how the apparatus having the above construction controls the recording density. The above conventional scheme using the P sensor 310 translates a change in the density of the pattern images formed on the drum 306 into a change in the toner concentration of the developer and thereby controls the toner concentration. As shown in FIG. 24, the toner concentration is sensed when a start key is pressed after the turn-on of a power supply, i.e., when the first copy is produced and every time ten copies are produced thereafter. When the toner concentration is determined short, the clutch solenoid 315 is turned on and then turned off for each one of ten copies up to the next toner sensing time, causing the roller 316 to supplement the toner. When the time for sensing the toner concentration is reached, the erase lamp 317 is turned off to allow the latent images of the white pattern $P_0$ and black pattern $P_1$ to be formed on the drum 306. As the developed images of the patterns $P_0$ and $P_1$ are brought to the position where the P sensor 310 is located, the sensor 310 turns on a light emitting diode to illuminate them while receiving the resulting reflection with a phototransistor. As a result the density of each pattern image is determined.

Figures 25A, 25B:
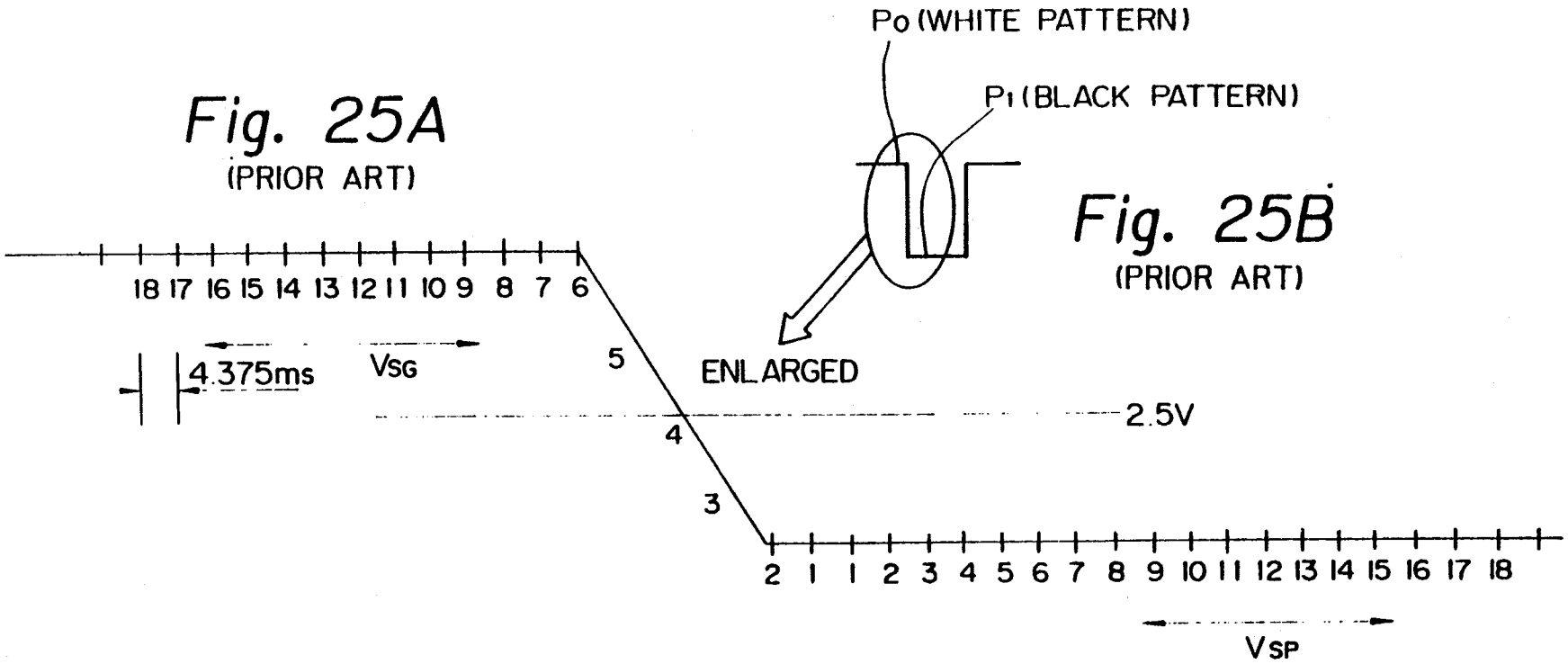
Fig. 25A (PRIOR ART)
Fig. 25B (PRIOR ART)

As shown in FIG. 25, the output of the P sensor 310 has a great value when the toner concentration is low (white pattern $P_0$) since the reflection is intense, or a small value when the toner concentration is high (black pattern $P_1$) since the reflection is not intense. The MPU 313 calculates a mean of 9–16 preceding the time when the output data from the P sensor 310 has become lower than 2.5 V four consecutive times, thereby producing $V_{SG}$. After the data from the P sensor 310 has become lower than 2.5 V four consecutive times, the MPU 313 calculates a mean of 9–16 following such an occurrence to thereby procedure $V_{SP}$.

Figure 26A:
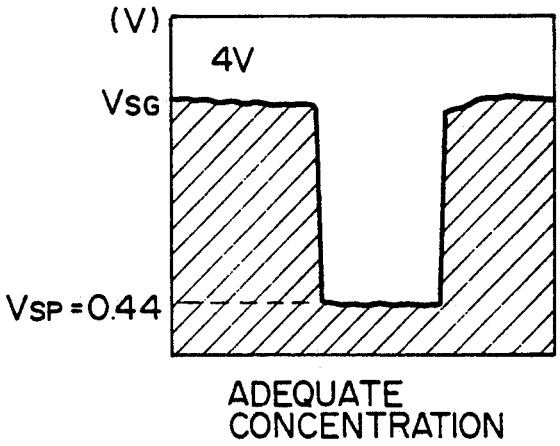
Fig. 26A PRIOR ART
Figure 26B:
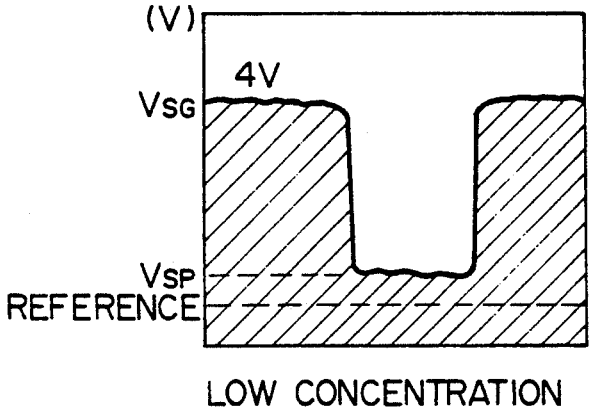
Fig. 26B PRIOR ART
Figure 26C:
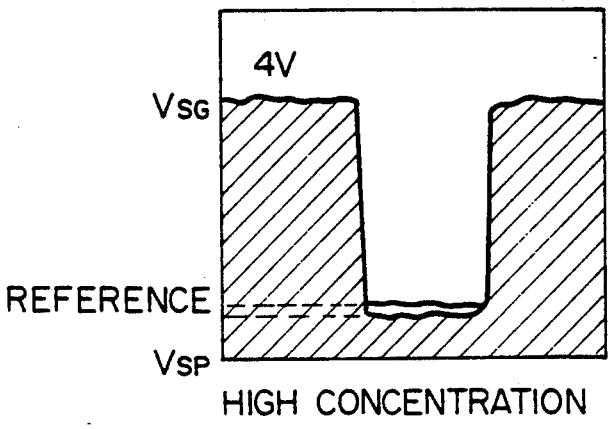
Fig. 26C PRIOR ART

As shown in FIG. 26A, assume that $V_{SG}$ is 4 V when the toner concentration of the developer is adequate, and that $V_{SP}$ is about 0.44 V then. As the toner concentration of the developer decreases, the pattern image developed on the drum 306 also becomes thin. Hence, as shown in FIG. 26B, $V_{SP}$ becomes higher than 0.44 V. On the other hand, when the toner concentration is high $V_{SP}$ becomes lower than 0.44 V since the pattern density increases, as shown in FIG. 26C. This allows whether or not to supplement the toner to be determined on the basis of the value of $V_{SP}$. In practice, since $V_{SG}$ is not always 4 V, the toner supplement is controlled on the basis of the ratio $V_{SP}/V_{SG}$ by using $V_{SP}/V_{SG}=1/9$ (nearly equal to 0.44/4) as a reference.

Preferred embodiments of the image forming method in accordance with the present invention will be described hereinafter.

Embodiment 1

Figure 1:
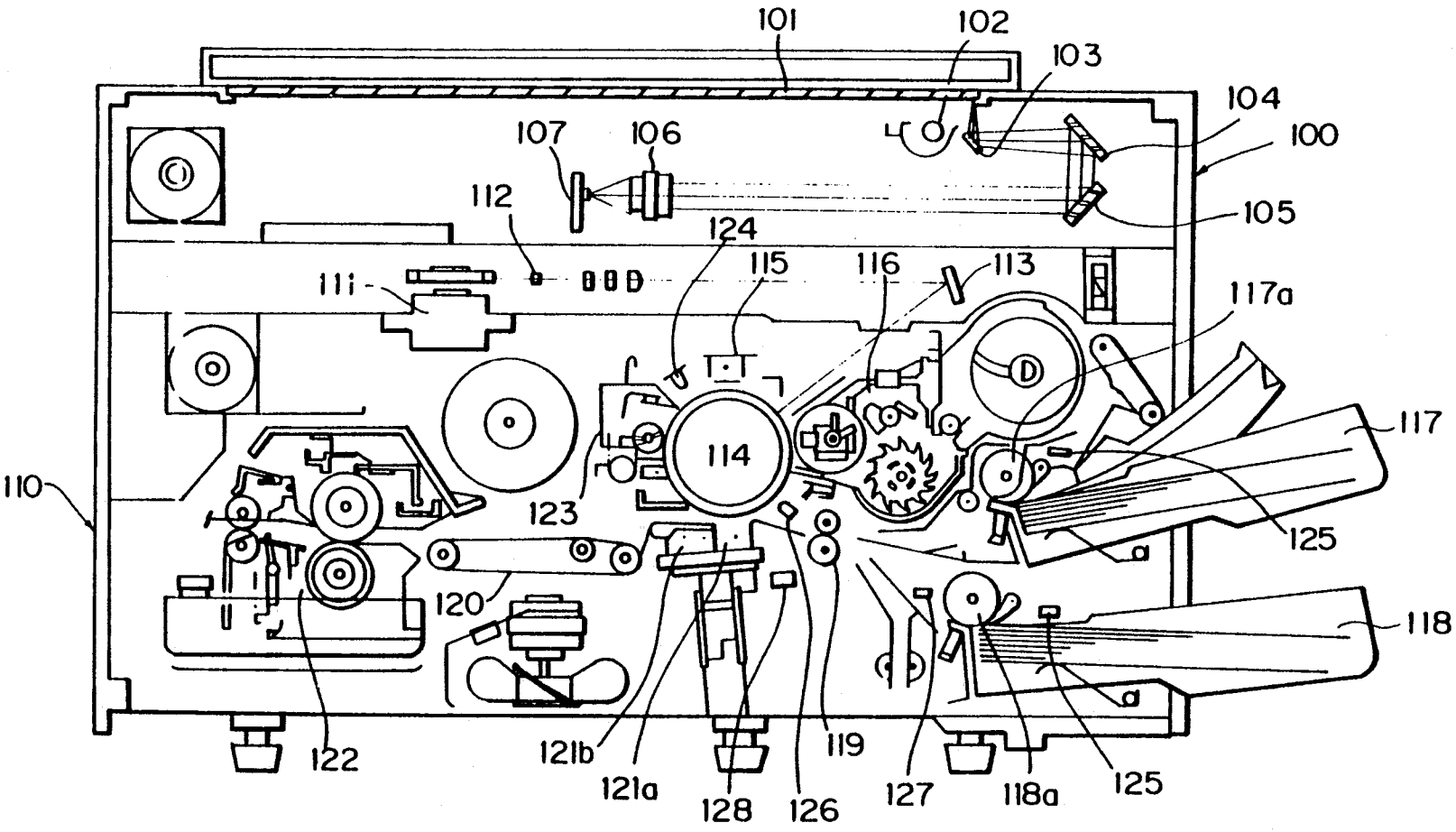
FIG. 1 is a section of an image forming apparatus to which Embodiment 1 of the present invention is applied.

FIG. 1 shows an image forming apparatus implemented with a first embodiment of the present invention and includes an image reading section 100 and an image forming section 110. As shown, the image reading section 100 has a glass platen 101 on which a document is to be laid. A light source 102 is moved relative to the document on the glass platen 101 to illuminate, or scan, it. A mirror 103 is moved together with the light source 102 for deflecting a reflection from the document. Mirrors 104 and 105 sequentially deflect the reflection from the mirror 103 each in a predetermined direction. A lens 106 converges the reflection from the mirror 105. The light propagated through the lens 106 is incident on a CCD image sensor 107.

The image forming section 110 has a polygonal mirror 111 which is rotated at high speed for steering a laser beam at constant angle. An f-theta lens 112 corrects the laser beam from the polygonal mirror 111 such that the laser beam has a constant interval on a photoconductive drum 114. The laser beam from the f-theta lens 112 is incident on the drum 114 via a mirror 113. A main charger 115 uniformly charges the surface of the drum 114 to predetermined polarity. After the laser beam from the mirror 113 has formed an electrostatic latent image on the charged surface of the drum 114, a developing unit 116 develops the latent image to produce a corresponding toner image.

Paper cassettes 117 and 118 are each loaded with papers of particular size and removably mounted on the apparatus body. Pick-up rollers 117*a* and 118*b* are respectively associated with the cassettes 117 and 118 for feeding the papers one by one toward an image transfer station. A register roller 119 drives the paper fed by the pick-up roller 117*a* or 118*a* to the image transfer station at a predetermined time. A transfer charger 121*a* transfers a toner image from the drum 114 to the paper fed by the register roller 119. After the image transfer, a separation charger 121*b* separates the paper from the drum 114. A belt 120 transports the paper separated from the drum 114 by the separation charger 121*b*. A fixing unit 122 fixes the toner image carried on the paper. A cleaning unit 123 removes the toner remaining on the drum 114 after the image transfer. Further, a discharge lamp 124 removes the charge also remaining on the drum 114 after the image transfer. A humidity sensor for sensing humidity, a timer for counting the interval between consecutive paper feeds, and a sensor for sensing the thickness of a paper, collectively designated by the reference numeral 125, are located near each of the cassettes 117 and 118. A pretransfer lamp (PTL) 126 effects pretransfer exposure. A portion 127 is responsive to the electric resistance of the paper. A timer 128 is provided for accumulating the period of time over which the transfer charger 121*a* and separation charger 121*b* have been used.

The illustrative embodiment uses a reversal development system wherein the drum 114 is made of a negatively chargeable OPC (Organic Photo Conductor) while the developer is implemented as a two component developer including a negatively chargeable toner. Further, in the embodiment, an image form signal is used as a signal indicative of an estimated amount of toner consumption. Specifically, the image form signal is implemented as the period of time for which the laser is turned on. The turn-on times of the laser are sequentially accumulated by a cumulative counter 202 which will be described with reference to FIG. 2.

In operation, the light source 102 illuminates the document laid on the glass platen 101. The resulting reflection is routed through the mirrors 103, 104 and 105 and lens 106 to the CCD image sensor 107. As the CCD image sensor 107 generates image data representative of the document image, the image data are subjected to predetermined image processing. A semiconductor laser, not shown, emits a laser beam having been modulated by the processed image data.

The laser beam is routed through the polygonal mirror 111, f-theta lens 112 and mirror 113 to the drum 114 which has been uniformly charged by the main charger 115 beforehand. As a result, the laser beam forms an electrostatic latent image on the drum 114. At this instant, the drum 114 has the background (dark portion) and the image portion (light portion) thereof usually deposited with a potential $V_D$ of about −800 V and a potential $V_L$ of about −100 V, respectively. Therefore, the latent image will be developed on the basis of a difference between such potentials and a bias potential for development $V_B$ of bout −600 V. The latent image is developed by the developing unit 116. The resulting toner image is transferred by the transfer charger 121*a* to a paper fed from the cassette 117 or 118 by the associated pick-up roller 117*a* or 117*b* and register roller 119. The paper carrying the toner image is separated from the drum 114 by the separation charger 121*b* and then transported to the fixing unit 122 by the belt 120. After the toner image has been fixed on the paper by the fixing unit 122, the paper is driven out of the apparatus. The cleaning unit 123 removes the toner remaining on the drum 114 after the image transfer, while the discharge lamp 124 removes the charge also remaining on the drum 144. The drum 144 is now ready to effect the next image formation. Before the image transfer by the transfer charger 121*a*, the PTL 126 shown in FIG. 1 illuminates the drum 114 to remove a needless charge therefrom.

A particular pattern for image density control is formed on the drum 114 outside of an image forming area once per fifteen copies. A reflection type optical sensor is located in close proximity to the drum 114. The sensor generates a voltage $V_{SP}$ associated with the reflectance of a reference image (developed version of the pattern for image density control), and a voltage $V_{SG}$ associated with the surface of the drum 114 inside the reference image. The ratio $V_{SP}/V_{SG}$ is compared with a particular ratio $V_{SP}/V_{SG}$ matching a target image density, whereby whether the image density is high or whether it is low is determined.

Figure 2:
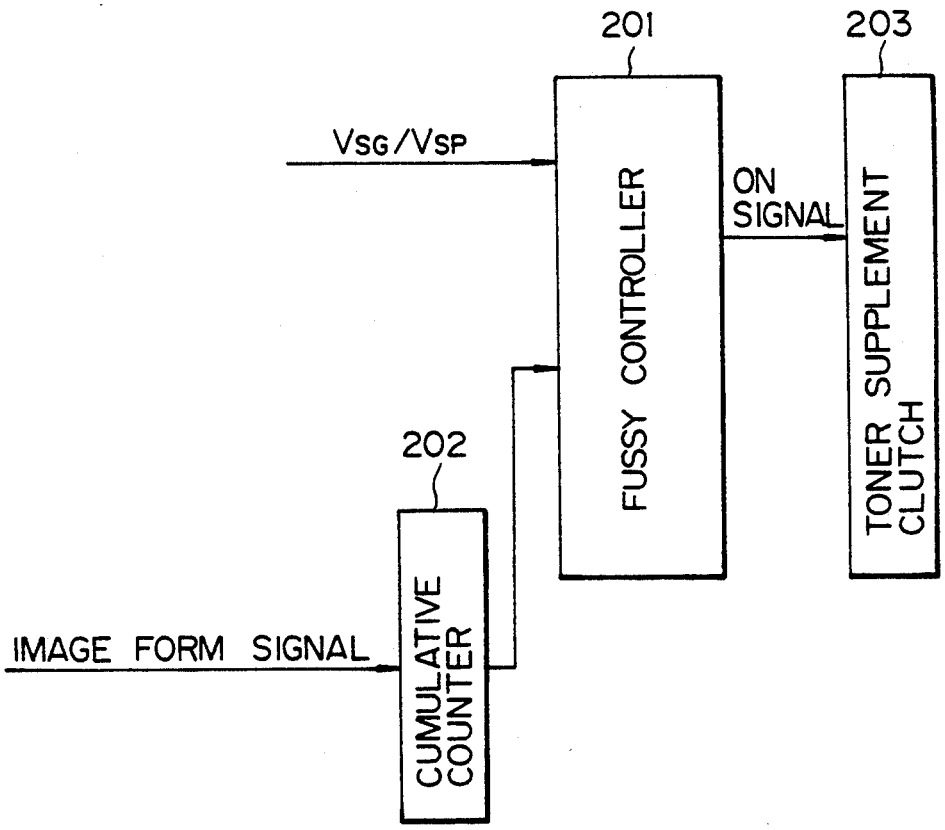
FIG. 2 is a block diagram schematically showing a control system for practicing Embodiment 1.

A control flow particular to the embodiment will be described with reference to FIG. 2. The ratio $V_{SP}/V_{SG}$ and the cumulative value of the image form signal are applied to a fuzzy controller 201. in response, the fuzzy controller 201 estimates the ON time of a toner supplement clutch 203 required to supplement an amount of toner necessary for the target image density to be maintained. It is to be noted that the cumulative value of the image form signal is the output of a cumulative counter 202 which counts the image form signal (turn-on time of the laser) corresponding to a single copy just before the estimation. By dividing the cumulative value by a cumulative count corresponding to a single black solid image of A3 size, it is possible to produce an image area ratio for a paper of A3 size.

An estimation procedure to be executed by the fuzzy controller 201 is as follows. The fuzzy controller 201 quantizes control rules expressed in a language to allow them to be replaced with actual numerical values. Since the result of estimation and, therefore, the control ability is critically influenced by the control rules, how to express the control rules is of primary importance. Hence, it is necessary to select parameters to be used adequately.

Figure 3:
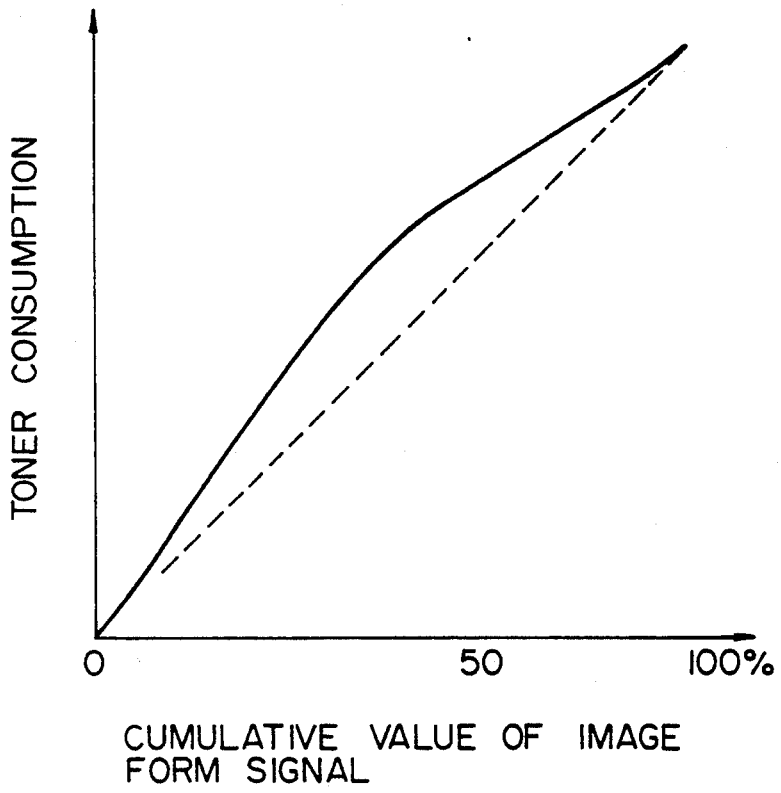
FIG. 3 plots a relation between the amount of toner consumption and the cumulative value of an image form signal.

In the illustrative embodiment, the target image density is represented by the ratio $V_{SP}/V_{SG}$ available with the optical sensor while the estimated toner consumption signal is implemented by the cumulative value of the image form signal. This is successful in preventing the control accuracy from being effected by the amount of image data formed between consecutive developed patterns for control, i.e., the amount of toner consumption. More specifically, this kind of scheme noticeably enhances the control accuracy, compared to the conventional scheme relying on the sensor output only. Further, the embodiment is also advantageous over the scheme which simply multiples image form signals. This is because the relation between the cumulative value of an image form signal and the amount of toner consumption is not linear, i.e., most of ordinary images are not fully solid images (see a solid curve in FIG. 3), and because such a relation is closely related to the ratio $V_{SP}/V_{sSG}$.

Using fuzzy estimation for the total estimation, the embodiment translates, for example, a fuzzy concept that the image is thin into an expression that the ratio $V_{SP}/V_{SG}$ of the optical sensor is small. This kind of relation is expressed in rules using a language, as listed in Table 1 below. In the embodiment, the rules each has a former half beginning with "if" and a latter half ending with "increase, decrease, et."

TABLE 1

| | | | |
|---|---|---|---|
| Rule 1 | If $V_{SP}/V_{SG}$ is medium high and image area ratio is extremely high | → | Increase supplement to positive side |
| Rule 2 | If $V_{SP}/V_{SG}$ is slightly high and image area ratio is slightly high | → | increase supplement to medium positive side |
| Rule 3 | If $V_{SP}/V_{SG}$ is slightly high and image area ratio is medium | → | slightly crease supplement to positive side |
| Rule 4 | If $V_{SP}/V_{SG}$ is almost target and image area ratio is medium | → | medium supplement |
| Rule 5 | If $V_{SP}/V_{SG}$ is slightly small and image area ratio is medium | → | slightly increase supplement to negative side |
| Rule 6 | If $V_{SP}/V_{SG}$ is slightly low and image area ratio is slightly low | → | increase supplement to medium negative side |
| Rule 7 | If $V_{SP}/V_{SG}$ is medium low and image area ratio is low | → | increase supplement to negative side |

Figure 4A:
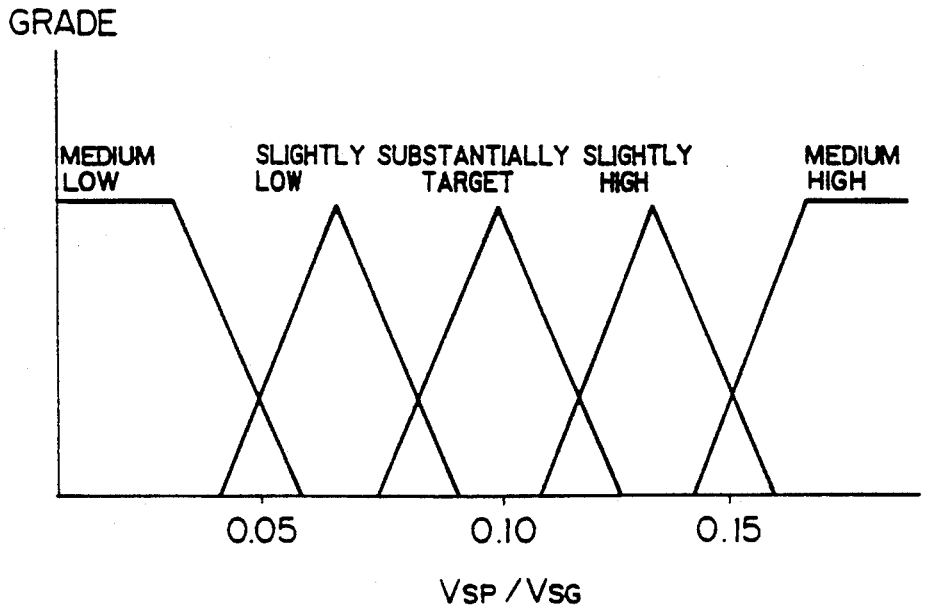
FIGS. 4A–4C show membership functions used in Embodiment 1.
Figure 4B:
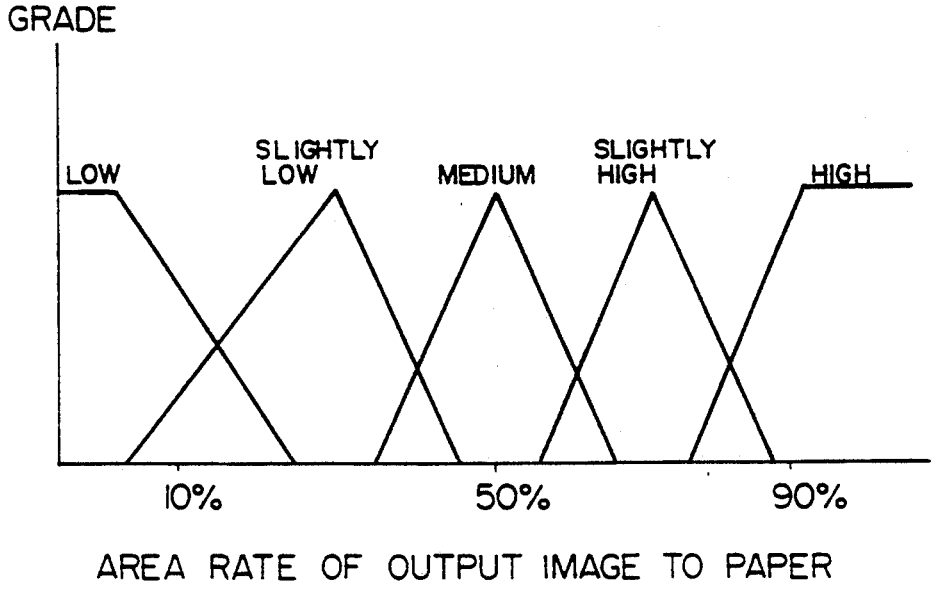
Figure 4C:
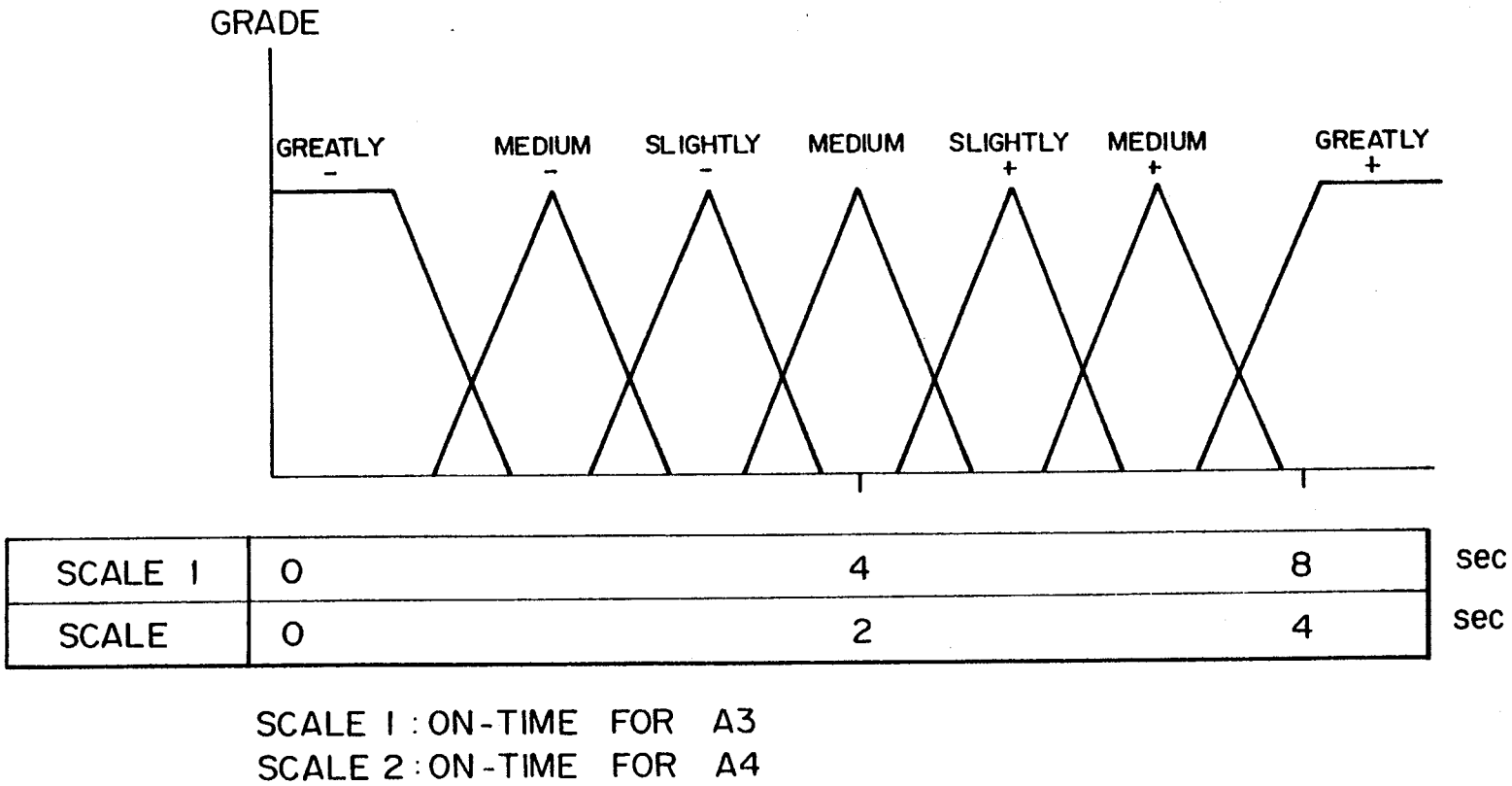

The seven rules listed above are represented by quantized fuzzy variables in terms of membership functions shown in FIGS. 4A–4C and can be calculated. It is to be noted that the above seven rules are only illustrative and may be replaced with a greater number of rules for achieving more delicate control. The gist is that the design matches a particular control system. For the estimation in the former half of each rule, the degree of conformity of the former half to the inputs is determined by producing MAX of the inputs and the variables of the former half, as usual. Then, MIN of the variable of the latter half and the degree of conformity of the former half is determined as a conclusion of the rule. The conclusion is determined with all of the given rules, and then MAX of all of the conclusions is produced to obtain the final result of estimation, i.e., the ON-time of the toner supplement clutch 203 required to supplement an amount of toner matching the set image density.

Figure 5:
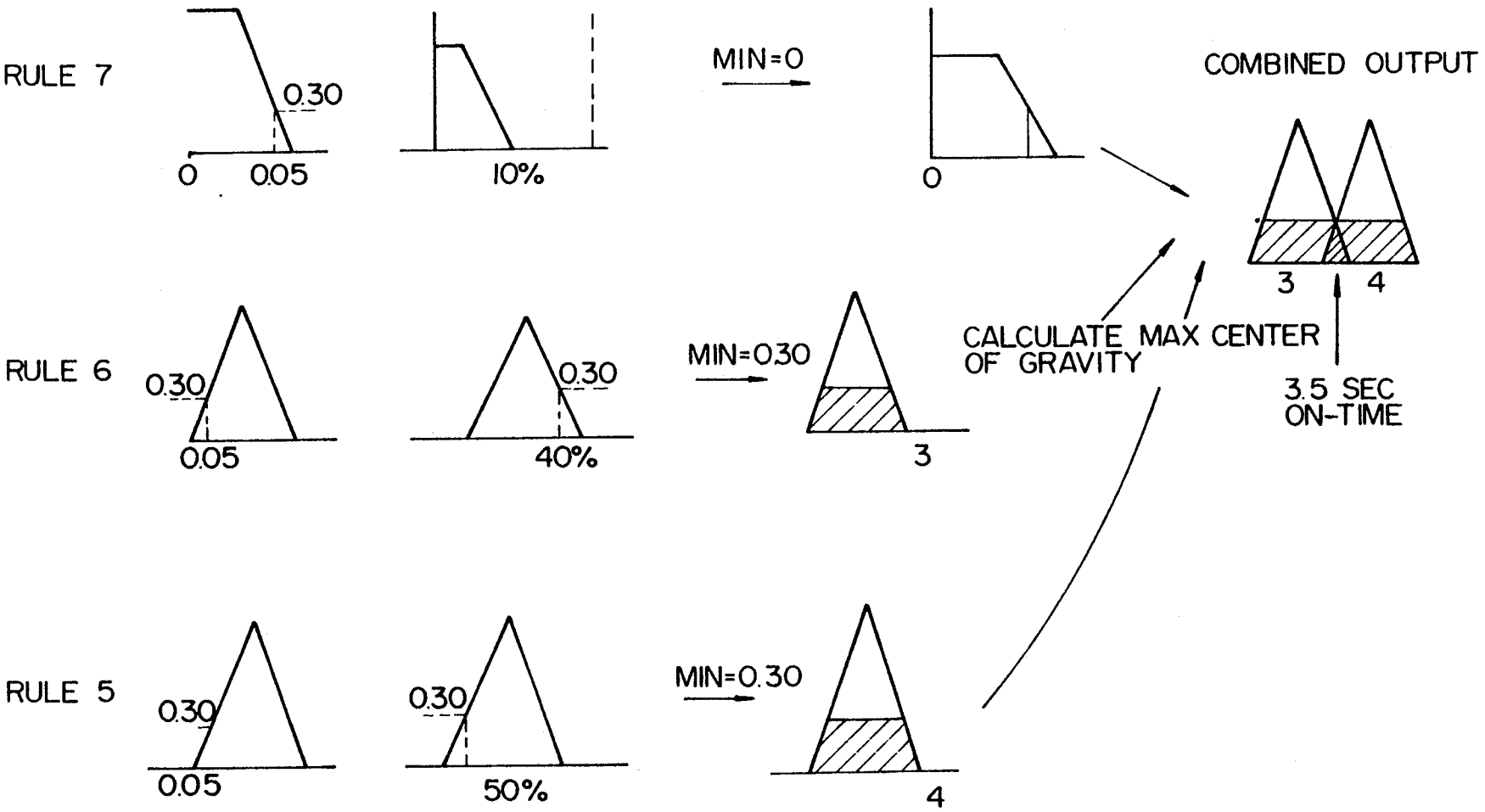
FIG. 5 demonstrates a specific estimation procedure of Embodiment 1.

Specifically, assume that the ratio $V_{SP}/V_{SG}$ is slightly small, and that the cumulative value is an output image area ratio of 40%. Then, a target amount of toner supplement is calculated by using the rules 1–7. Assume that the ratio $V_{SP}/V_{SG}$ is 0.05, and the area ratio of the cumulative value of image form signal to the output paper (A3) is 40%, as shown in FIG. 5. Then, in the rule 7, $V_{SP}/V_{SG}$ of 0.05 is determined to belong to a matrix of medium low $V_{SP}/V_{SG}$'s and has a grade of 0.30 (degree of conformity). In this way, in each of the rules, the points where the input intersects the membership functions are calculated. Among the intersecting points, the minimum value (0 in rule 7) is calculated to produce a conclusion. After the conclusions of all of the rules have been produced, MAX of them is determined by a composite output (indicated by hatching), and then the center of gravity of MAX is determined. Consequently, a result of estimation is obtained, i.e., a 3.5 seconds ON-time of the clutch 203.

The above estimation is executed with each copy. At times other than the time for forming the pattern for control (once per fifteen copies), the previous $V_{SP}/V_{SG}$ data is used, and only the image data is updated. Although the document size has been assumed to be A3, the embodiment automatically changes the scale of membership functions in matching relation to the size of output image. For example, in the case of a document of A4 size, the scale is switched to ½ (from scale 1 to scale 2 shown in FIG. 4C). This is successful taking in the relation of the amount of toner consumption to the cumulative value of image form signal/document area with no regard to the document size and without assigning membership functions size by size.

While the embodiment used the turn-on time of the laser as the estimated toner consumption signal, it is also practicable with, for example, data read by the scanner or the data resulting from image processing.

As stated above, the illustrative embodiment executes delicate control over the toner supplement by fuzzy estimation even when the pattern for control is not formed. This insures sharp response to the varying ambient conditions and the kind of documents and, therefore, controls the image density to desired one at all times, compared to the case using a P sensor or a toner concentration sensor only.

Figure 6B:
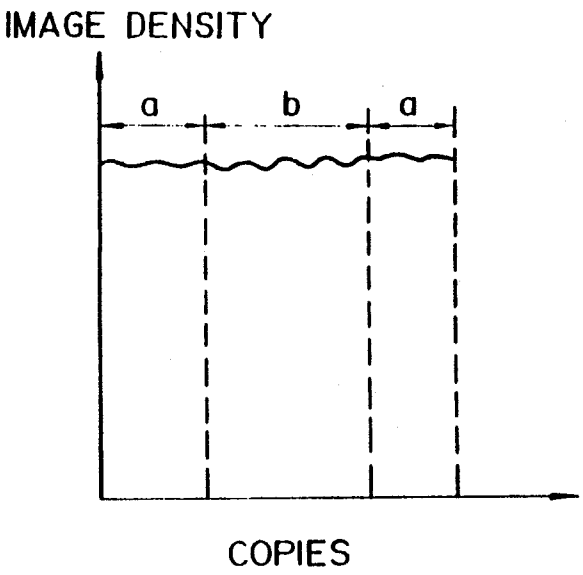
FIG. 6 are plots representative of toner supplement control of a conventional method and that of Embodiment 1.
Figure 6A:
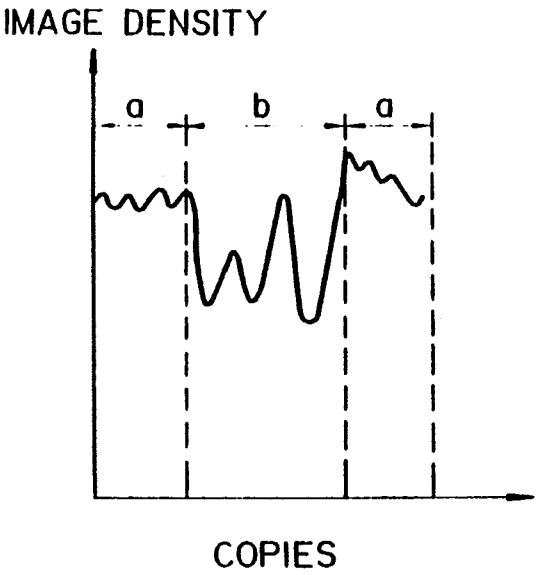
Fig. 6A (PRIOR ART)

FIG. 6 show plots useful for understanding the advantage of the toner supply control of the embodiment over the conventional one which forms a pattern for control once per one to ten copies. As shown, with the embodiment, a stable image density is insured even when the continuous reproduction of documents of A4 size and having an image area of 6% is immediately followed by the continuous reproduction of documents of A4 size and having an image area of 60%. Stated another way, the embodiment is capable of controlling the image density, i.e., toner supplement with unprecedented accuracy in matching relation to various kinds of document areas.

Moreover, since the embodiment executes the control by using the image form signal, it is more accurate in control than the prior art even when the pattern for control is formed at an interval two or three times longer than the conventional one. In addition, by changing the fuzzy rules or estimation rules, it is possible to apply the embodiment to the process control of different types of image forming apparatuses.

Embodiment 2

Figure 7:
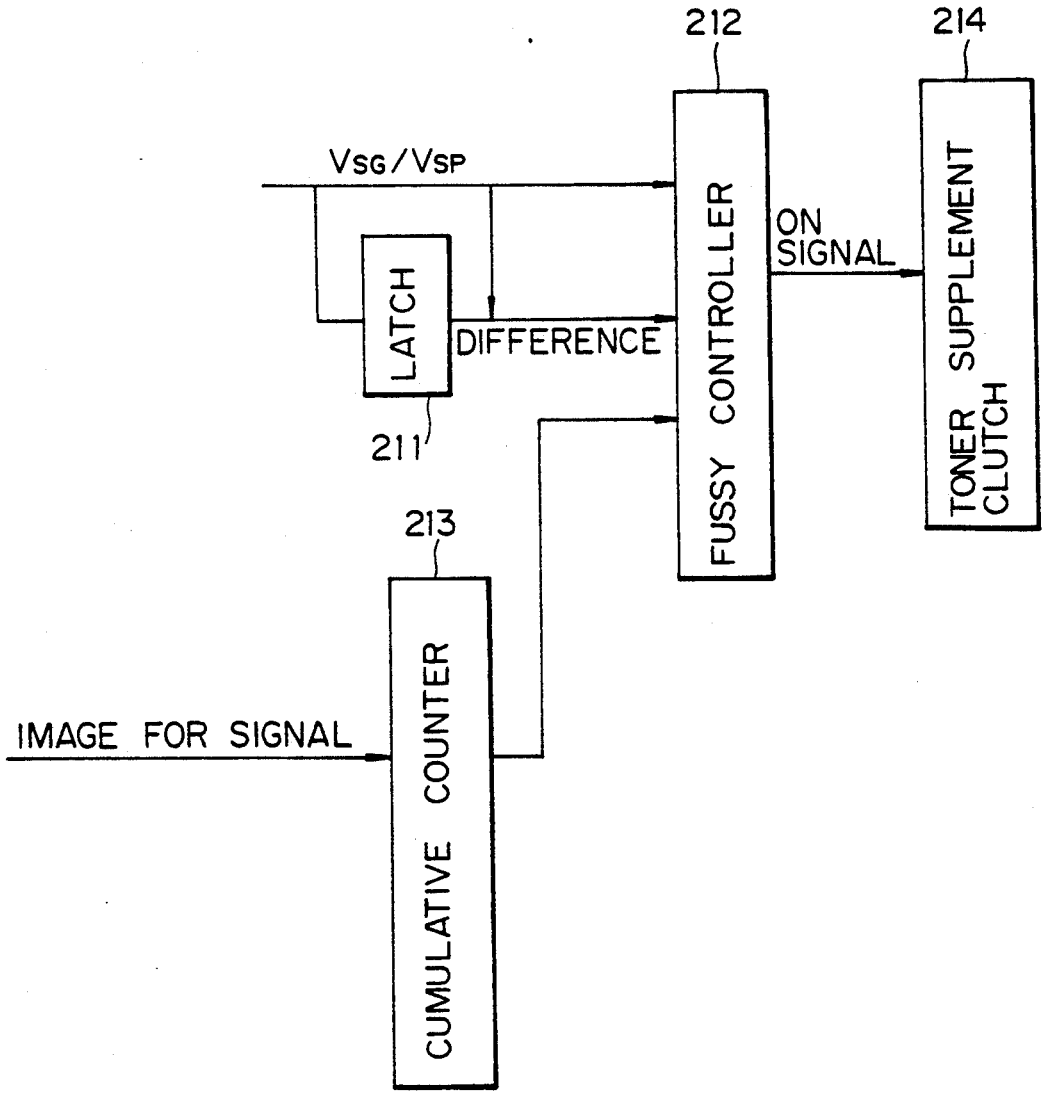
FIG. 7 is a block diagram schematically showing a control system of Embodiment 2.
Figure 8A:
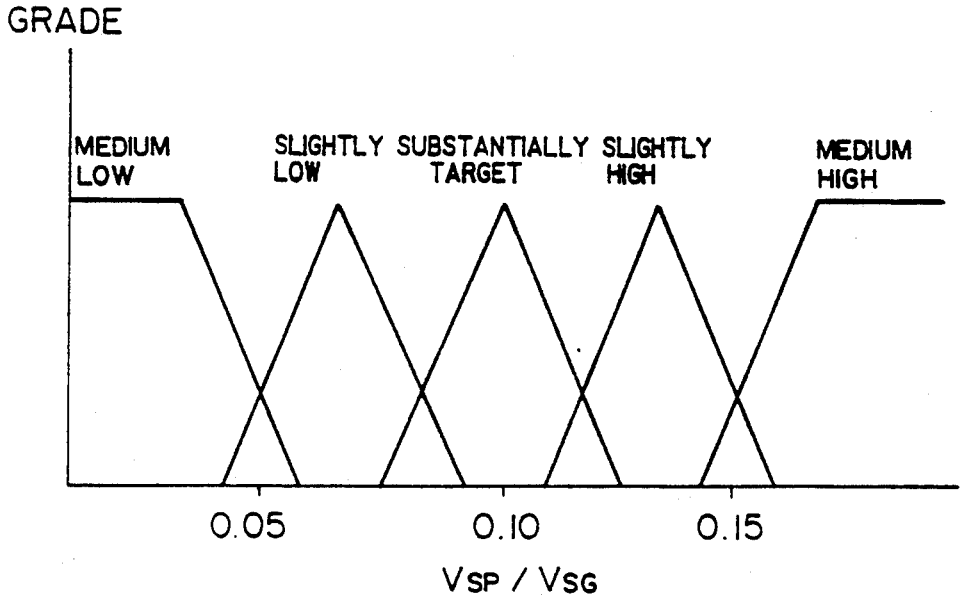
FIGS. 8A–8D show membership functions used in Embodiment 2.
Figure 8B:
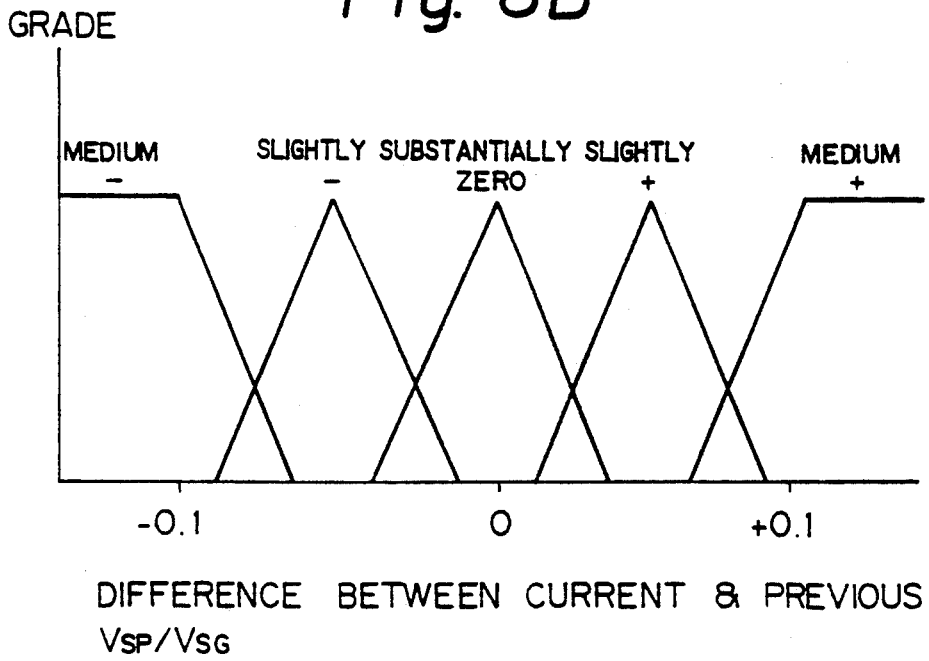
Figure 8C:
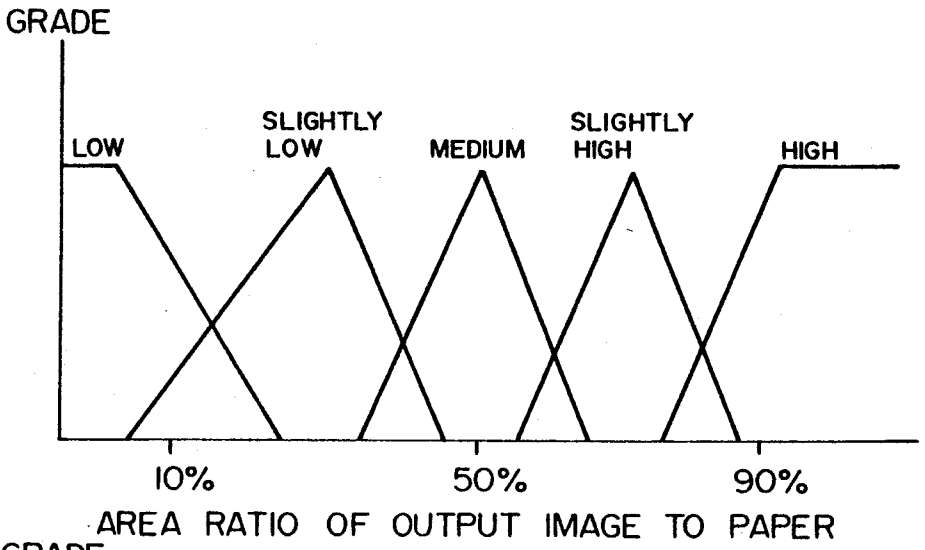
Figure 8D:
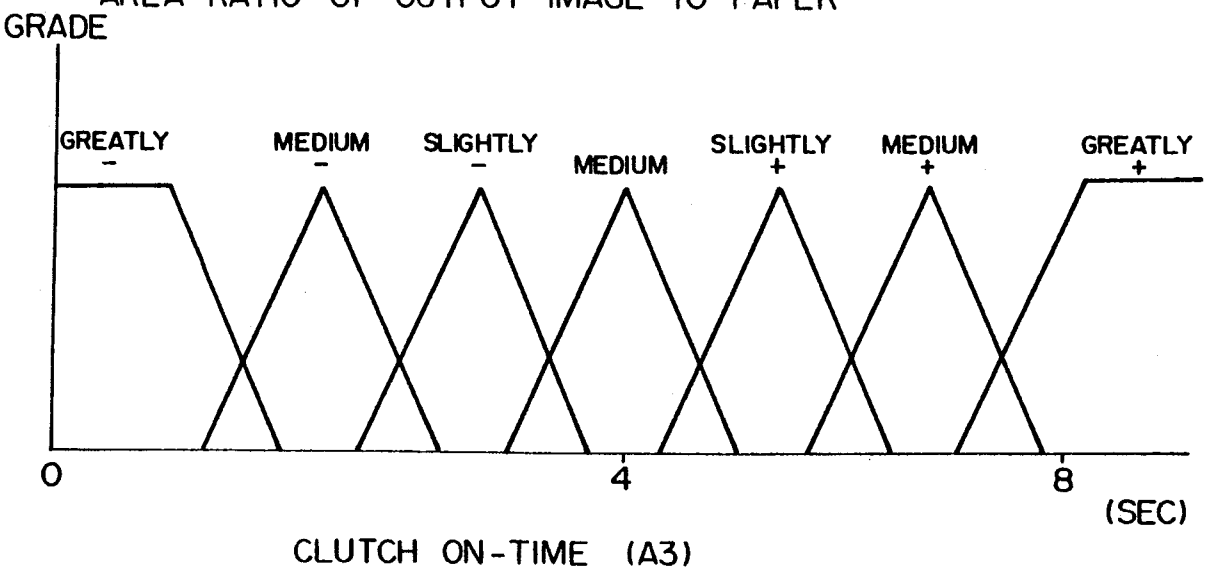

Referring to FIG. 7, a control system representative of a second embodiment of the present invention will be described. This embodiment is also practicable with the image forming apparatus described in relation to Embodiment 1.

As shown, a fuzzy controller 212 receives the ratio $V_{SP}/V_{SG}$, a difference between the current $V_{SP}/V_{SG}$ and the previous $V_{SP}/V_{SG}$ via a latch 211, and the ratio of cumulative value of image form signal to the paper area. In response, the controller 212 changes the scale of output membership functions on the basis of the paper size and then calculates the ON-time of the clutch 214 necessary for a required amount of toner to be supplemented, as in the first embodiment. The cumulative value of image form signal is a value which a cumulative counter 213 produces by accumulating an image form signal (turn-on time of laser) corresponding to one copy just before the estimation. The cumulative value is divided by a cumulative count corresponding to a single black solid image of A3 size to produce an image area ratio for a paper of A3 size. $V_{SP}/V_{SG}$, as well as history data thereof, is maintained the same until new inputs arrive while the image data is changed copy by copy. The calculation is performed every time a copy is to be produced. This part of the operation is the same as in the first embodiment.

The fuzzy controller 212 performs estimation, as follows. In the embodiment, a target image sensor is represented by $V_{SP}/V_{SG}$ of the optical sensor. Further, the cumulative value of image form signal is used as an estimated toner consumption signal to prevent the control accuracy from being effected by the amount of image data formed between the consecutive patterns for control (stated another way, the amount of toner consumption). In addition, the history of $V_{SP}/V_{SG}$ is taken in as data so as to calculate the required toner supplement time at all times.

This embodiment is essentially the same as Embodiment 1 regarding the rules for fuzzy estimation and the calculating method, except for the following. In this embodiment, since the history data of $V_{SP}/V_{SG}$ is added, there will be described an additional rule that when the current $V_{SP}/V_{SG}$ is high, the previous $V_{SP}/V_{SG}$ was as high as the current one, and images similar to the previous ones are continuously copied, then a greater amount of toner should be supplemented next.time. FIGS. 8A–8D show membership functions particular to the illustrative embodiment.

As stated above, this embodiment promotes even higher control accuracy than Embodiment 1 since it additionally uses the history data of $V_{SP}/V_{SG}$. Also, this embodiment reduces the number of times that the pattern for control should be formed. The embodiment, like Embodiment 1 (see FIG. 6), is capable of executing accurate image density (toner supply) control matching various document areas. Moreover, since the embodiment uses the image form signal, it achieves higher control accuracy than the prior art even when the conventional interval between consecutive patterns for control (once per one to ten copies) is doubled or tripled.

Embodiment 3

Figure 9:
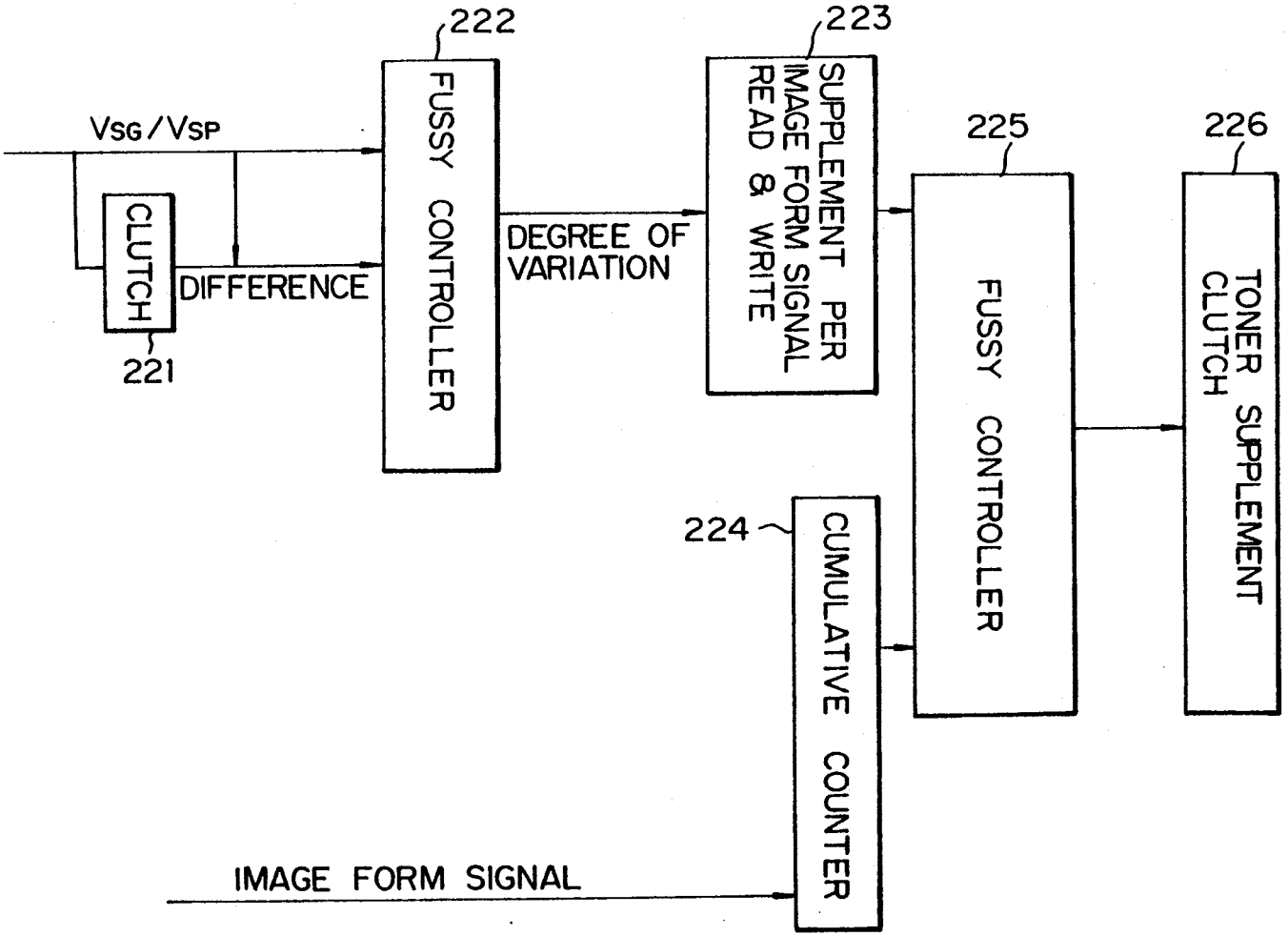
FIG. 9 is a block diagram schematically showing a control system of Embodiment 3.
Figure 10A:
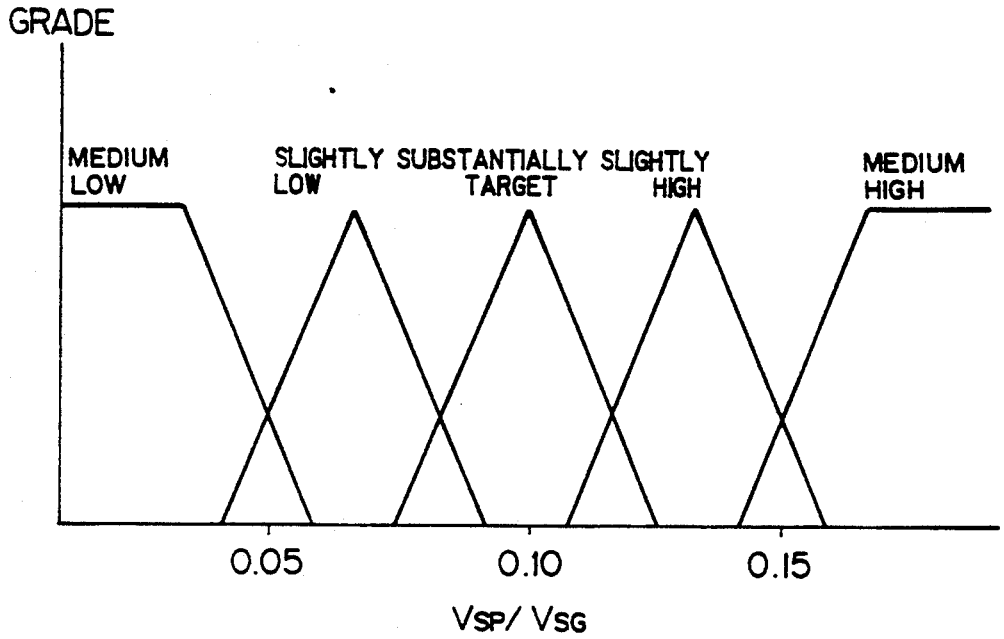
FIGS. 10A–10C show membership functions used in Embodiment 3.
Figure 10B:
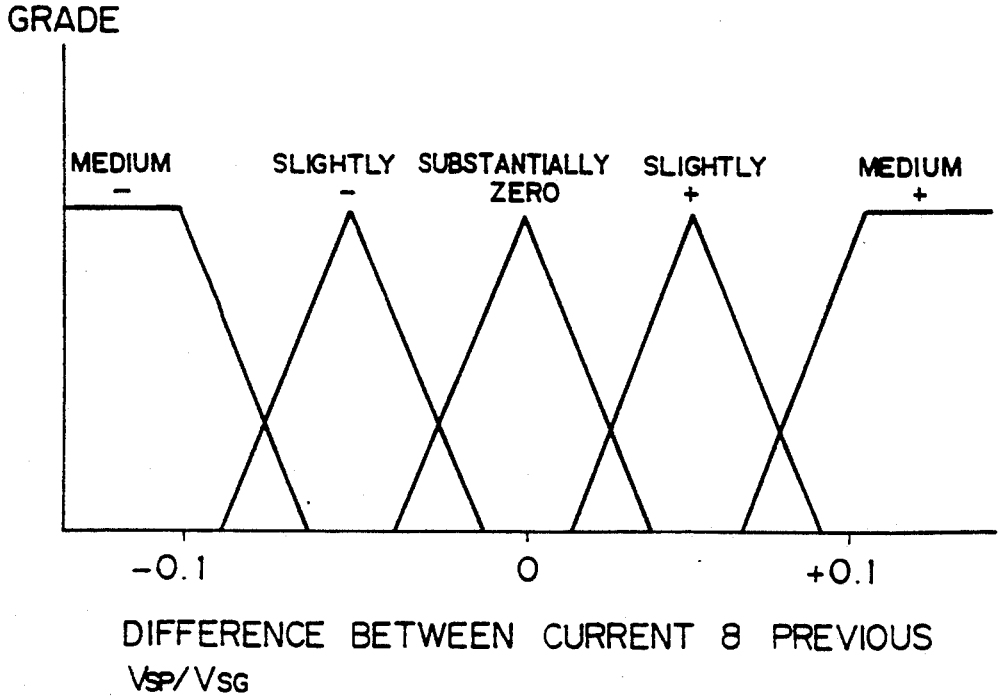
Figure 10C:
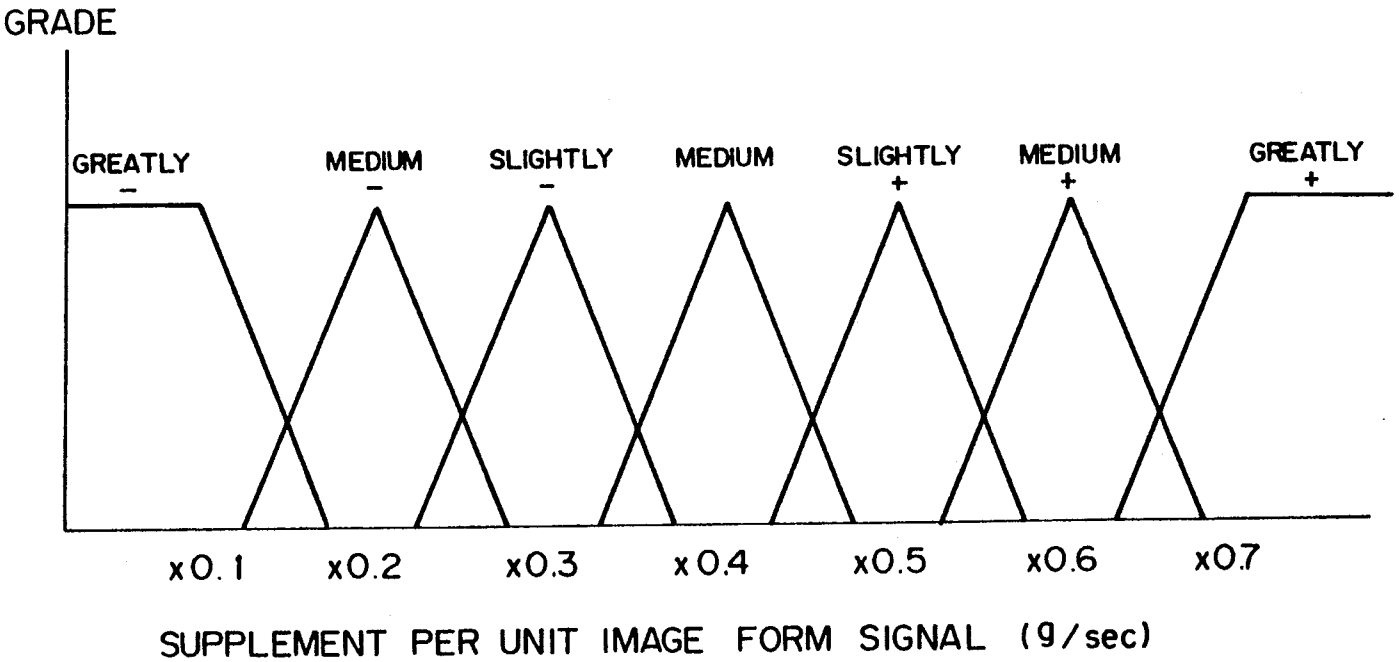
Figure 11A:
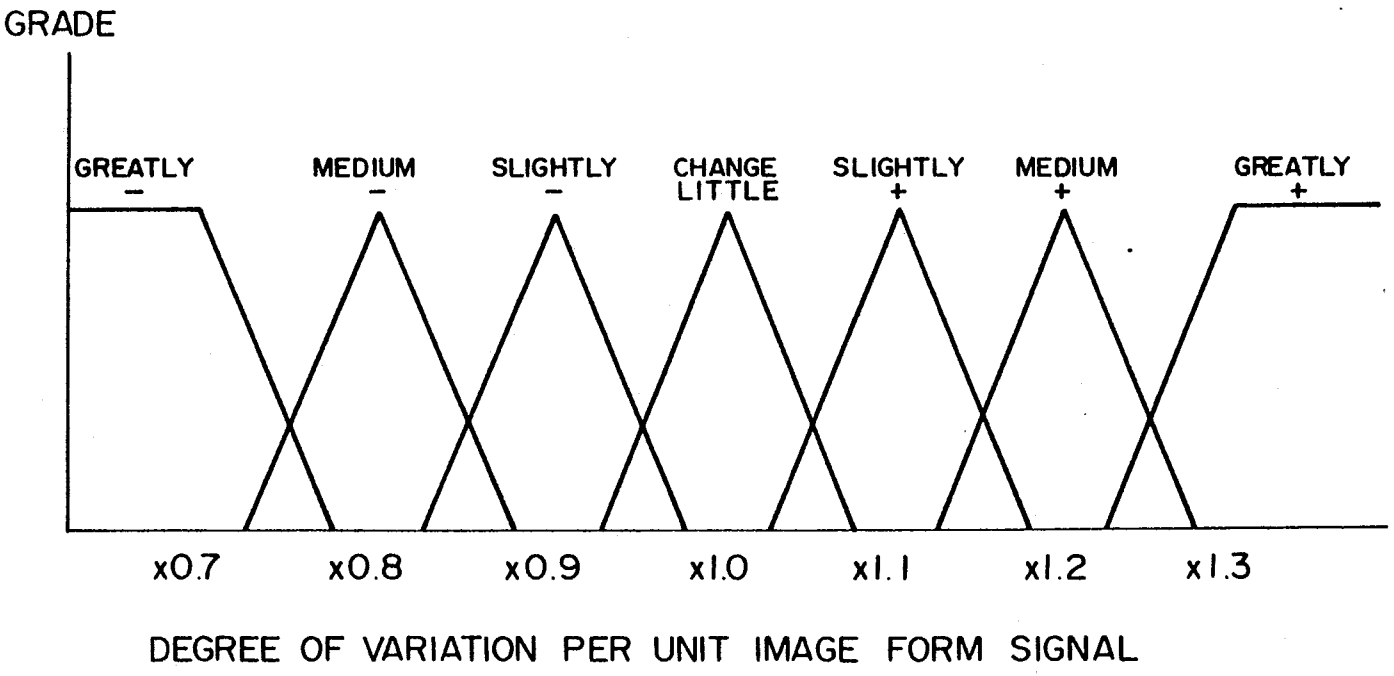
FIGS. 11A–11C show membership functions used in Embodiment 3.
Figure 11B:
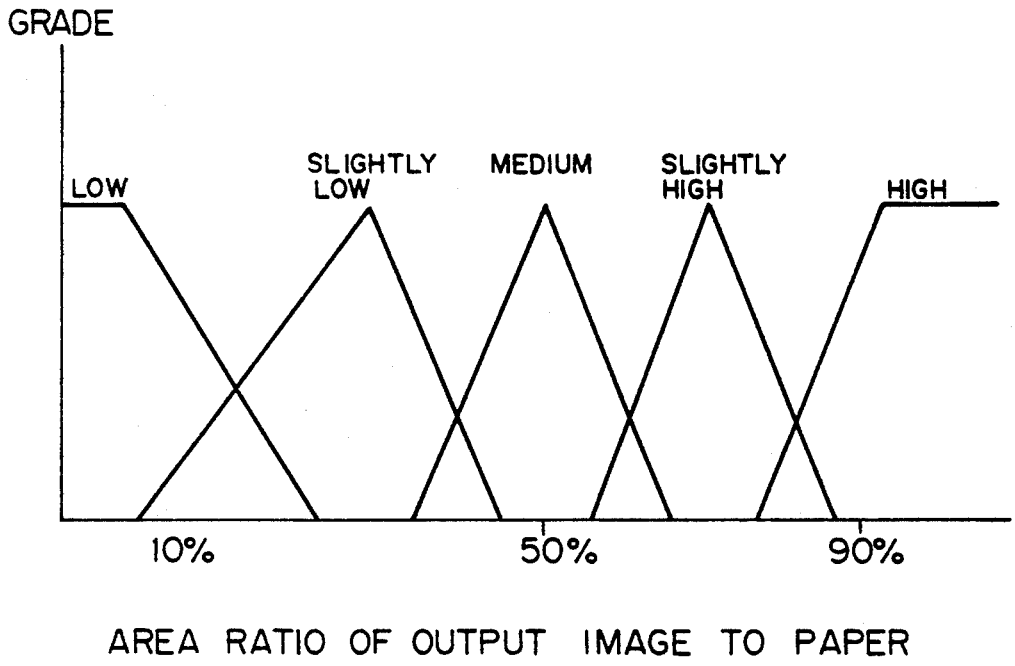
Figure 11C:
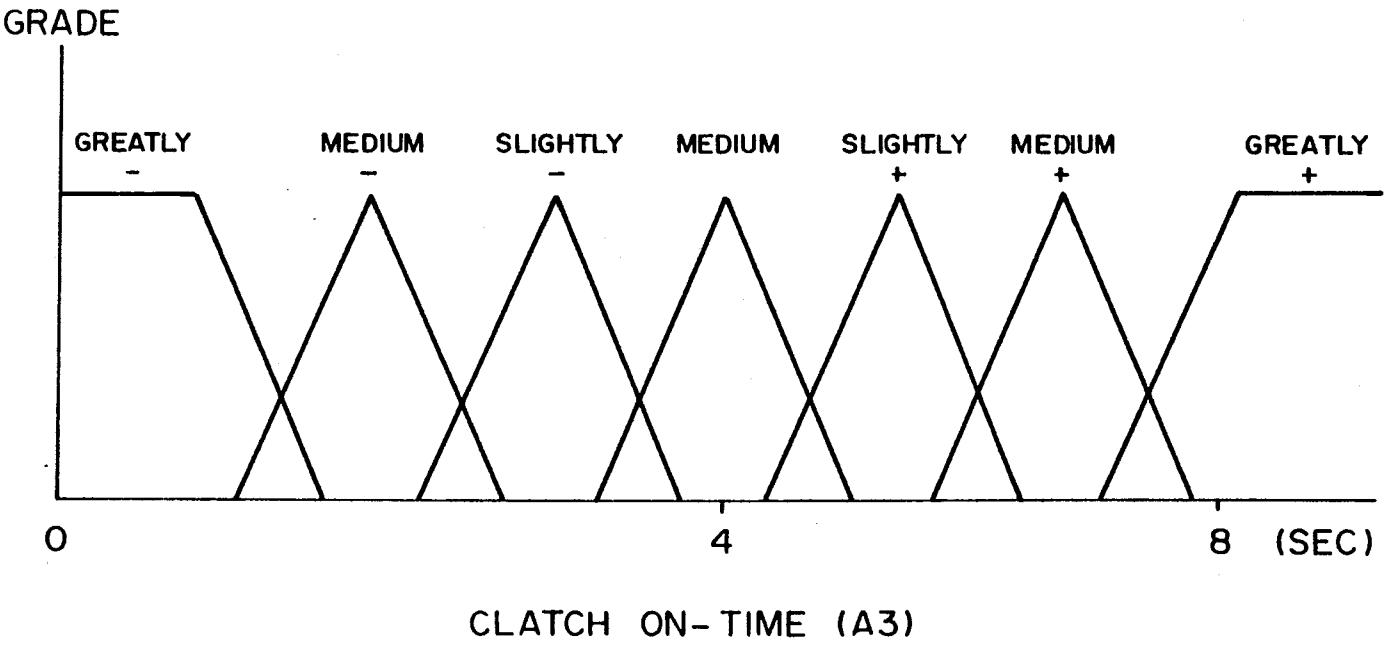

FIG. 9 shows a control system representative of a third embodiment of the present invention. This embodiment is also practicable with the image forming apparatus described in relation to Embodiment 1.

In FIG. 9, a fuzzy controller 222 receives $V_{SP}/V_{SG}$, and a difference between the current $V_{SP}/V_{SG}$ and the previous $V_{SP}/V_{SG}$ via a latch 221. In response, the controller 222 estimates a degree of variation in the amount of toner supplement on the basis of a unit image form signal, thereby determining an amount of toner supplement (here, degree of variation) per unit supplement amount. A toner supplement per unit image form signal read and write section 223 stores an amount of toner supplement per unit image form signal matching the degree of variation determined by the fuzzy controller 222. On receiving the amount of toner supplement per unit image form signal and the conductive value of image form signal, a fuzzy controller 225 calculates the ON-time of a toner supplement clutch 226 necessary for a required amount of toner to be supplemented. The cumulative value of image form signal is a value which a cumulative counter 224 produces by counting an image form signal (turn-on time of laser) corresponding to immediately preceding one document.

Stated another way, the fuzzy controller 222 receives $V_{SP}/V_{SG}$ (as well as history data thereof) at a predetermined interval, e.g., once per fifteen copies. The read and write section 223 holds the amount of toner supplement per unit image form signal matching the degree of variation determined by the fuzzy controller 222 until the next inputs arrive, e.g.) for a period of time corresponding to fifteen copies). On the other hand, the fuzzy controller 225 calculates the ON-time of the toner supplement clutch 226 in response to the image form signal appearing from the cumulative counter 224 once for each document, and the amount of toner supplement per unit image form signal matching the degree of variation stored in the read and write section 223.

It is noteworthy that since this embodiment holds the output of the fuzzy controller 222 in the read and write section 223, it is not necessary for $V_{SP}/V_{SG}$ (and history data thereof) to be held separately by another means until new inputs arrive.

Generally, the speed of fuzzy calculation depends on the ratio of the multiples of the input steps of input factors. In light of this, in this embodiment the calculation block is divided on the basis of the input timings of the estimation input data, and the output of the block having a longer timing period is latched until the next inputs arrive while the latched value is fed to the other block having a shorter timing period. Therefore, even when the pattern for control is not formed, adequate control over toner supplement matching the toner consumption can be executed by using the previous data and image form signal. In addition, rapid processing is enhanced to make the embodiment adaptive even to high speed machines.

The rules for fuzzy estimation and the calculation method of this embodiment are essentially the same as those of Embodiment 1 and, therefore, will not be described to avoid redundancy. FIGS. 10A-10C and FIGS. 11A-11C show respectively the membership functions of the fuzzy controller 222 and those of the fuzzy controller 225. The embodiment, like Embodiment 1 (see FIG. 6) is capable of executing accurate image density (toner supply) control matching various document areas. Moreover, since the embodiment uses the image form signal, it achieves higher control accuracy than the prior art even when the conventional interval between consecutive patterns for control (once per one to ten copies) is doubled or tripled.

Embodiment 4

Figure 12:
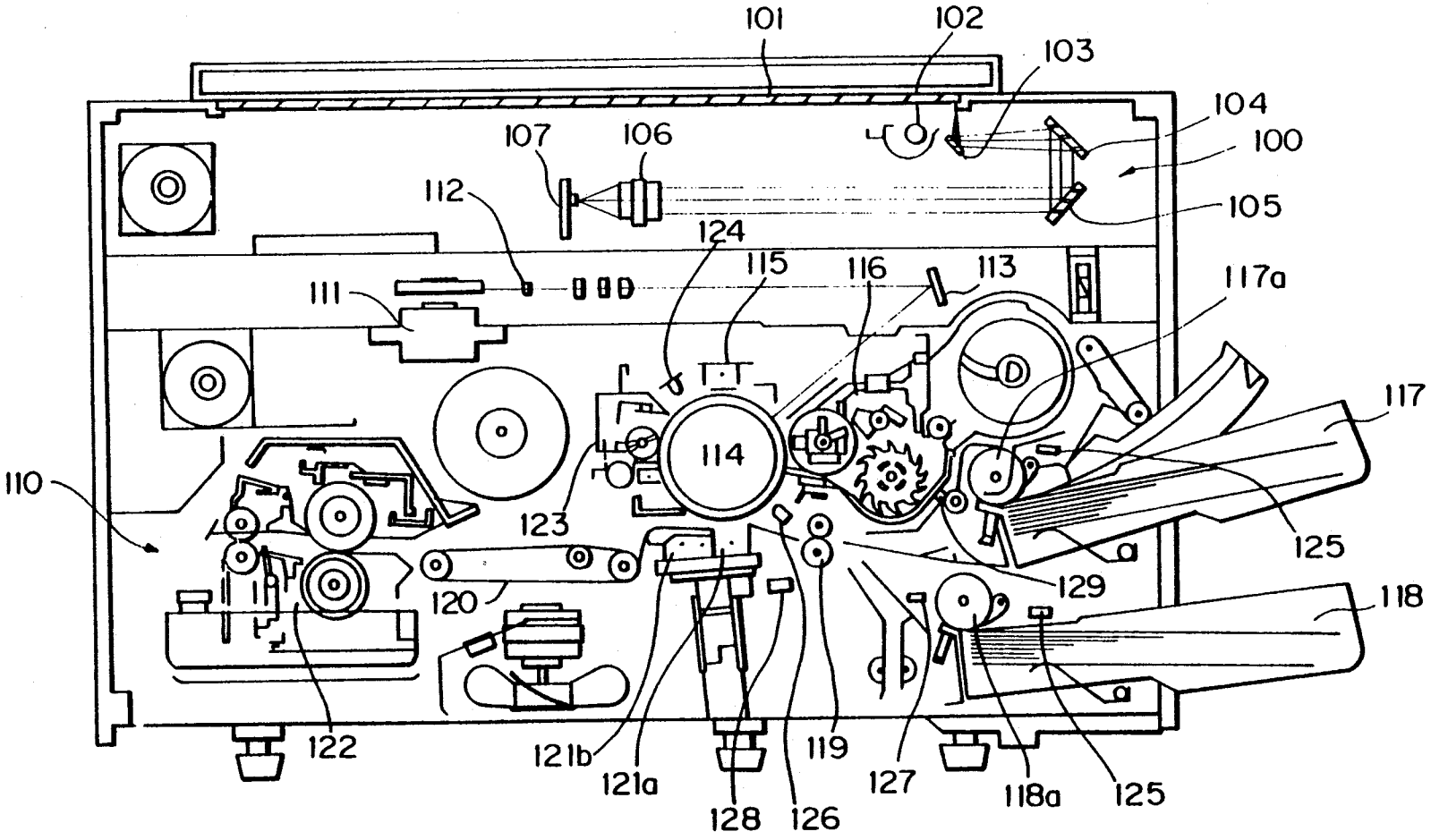
FIG. 12 is a section of an image forming apparatus implemented with Embodiment 4.

FIG. 12 shows an image forming apparatus implemented with a fourth embodiment of the present invention. As shown, the developing unit 116 accommodates therein a toner sensor 129 for sensing the toner concentration of the developer. The toner sensor 129 generates an output representative of means data of five adjoining points every other copy. The toner sensor 129 is of the type outputting a variation in permeability due to a variation in tone concentration as a variation in voltage. The output voltage of the toner sensor 129 is compared with a voltage representative of a target toner concentration to determine whether the toner concentration is high or whether it is low. Regarding the rest of the construction, this embodiment is identical with Embodiment 1.

Figure 13:
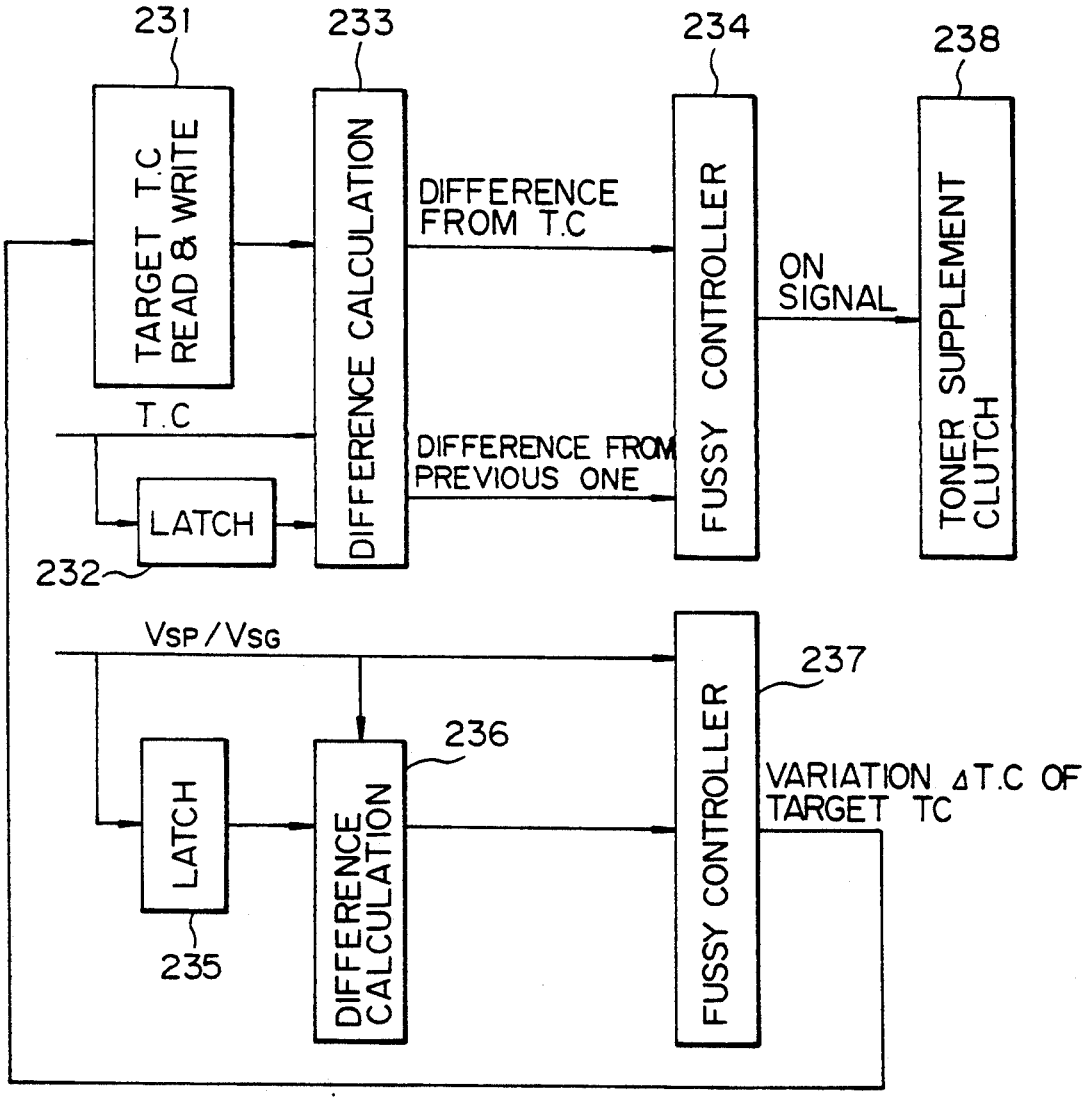
FIG. 13 is a block diagram schematically showing a control system of Embodiment 4.

Control to be executed by this embodiment will be described with reference to FIG. 13. As shown, a difference between the current toner concentration and the target concentration and a difference between the current concentration and the previous concentration are applied to a fuzzy controller 234 via a target TC (Toner Concentration) read and write section 231, a latch 232, and a difference calculation 233. In response, the fuzzy controller 234 estimates an amount of toner supplement (here, supplement time) to control a toner supplement clutch 238. On the other hand, a difference between the current $V_{SP}/V_{SG}$ and a target $V_{SP}/V_{SG}$ and a difference between the current $V_{SP}/V_{SG}$ and the previous one are applied to a fuzzy controller 237 via a latch 235 and a difference calculation 236. Then, the fuzzy controller 237 changes the target toner concentration matching the inputs and stores the new concentration in the TC read and write section 231 until new inputs arrive. In this manner, the output of the fuzzy controller 237 is a variation ($\Delta$TC) of target toner concentration and not an absolute amount. This embodiment, therefore, is capable of coping even with a change in the output characteristic of the toner sensor due to aging.

Generally, the speed of fuzzy calculation depends on the ratio of the multiples of the input steps of input factors. In light of this, in this embodiment the calculation block is divided on the basis of the input timings of the estimation input data, and the output of the block having a longer timing period is latched until the next inputs arrives while the latched value is fed to the other block having a shorter timing period. Therefore, even when the pattern for control is not formed, adequate control over toner supplement matching the toner consumption can be executed by using the previous data and image form signal. In addition, rapid processing is enhanced to make the embodiment adaptive even to high speed machines.

Estimation procedures to be executed by the fuzzy controllers 234 and 237 are as follows. The fuzzy controllers 234 and 237 quantize control rules expressed in a language to allow them to be replaced with actual numerical values. Since the result of estimation and, therefore, the control ability is critically influenced by the control rules, how to express the control rules is of primary importance. Hence, it is necessary to select parameters to be used adequately.

In this embodiment, a target image density is represented by $V_{SP}/V_{SG}$ of the optical sensor. Using the history data of $V_{SP}/V_{SG}$ as data, the embodiment determines whether or not an image is stable and, based on the result of decision, determines whether or not to change the target toner concentration. This is because should the target toner concentration be changed despite the unstable image condition, the image density to be finally reached might fail to converge due to the time lag particular to toner supplement. Further, by using the difference between the actual toner concentration and the target concentration and the history data of the concentration, it is possible to estimate a future concentration and, therefore, to change the amount of supplement beforehand. This is successful in setting up the target concentration at all times.

Using fuzzy estimation for the total estimation, the embodiment translates, for example, a fuzzy concept that the image is thin into an expression that the ratio $V_{SP}/V_{SG}$ of the optical sensor is small. This kind of relation is expressed in rules using a language, as listed in Tables 2 and 3 below. Tables 2 and 3 show respectively the control rules of the fuzzy controller 234 and the control rules of the fuzzy controller 237.

TABLE 2

| | |
|---|---|
| Rule 1 | If TC is medium lower than target and difference from previous one is substantially zero, increase supplement to positive side |
| Rule 2 | If TC is slightly lower than target and difference from previous one is slightly negative, increase supplement to medium positive side |
| Rule 3 | If TC is slightly lower than target and if difference from previous one is slightly positive, slightly increase supplement to positive side |
| Rule 4 | If TC is substantially target and difference from previous one is substantially zero, set up medium supplement |
| Rule 5 | If TC is slightly higher than target and difference from |

TABLE 2-continued

| | |
|---|---|
| | previous one is slightly negative, slightly increase supplement |
| Rule 6 | If TC is slightly higher than target and difference from previous one is slightly positive, increase supplement to medium negative side |
| Rule 7 | If TC is medium higher than target and difference from previous one is substantially zero, increase supplement to negative side |

TABLE 3

| | |
|---|---|
| Rule 8 | If $V_{SP}/V_{SG}$ is slightly low and difference from previous one is substantially zero, slightly increase target TC |
| Rule 9 | If $V_{SP}/V_{SG}$ is substantially target and difference from previous one is substantially zero, change target TC little |
| Rule 10 | If $V_{SP}/V_{SG}$ is slightly high and difference from previous one is substantially zero, slightly reduce target TC |

Figures 14, 14A:
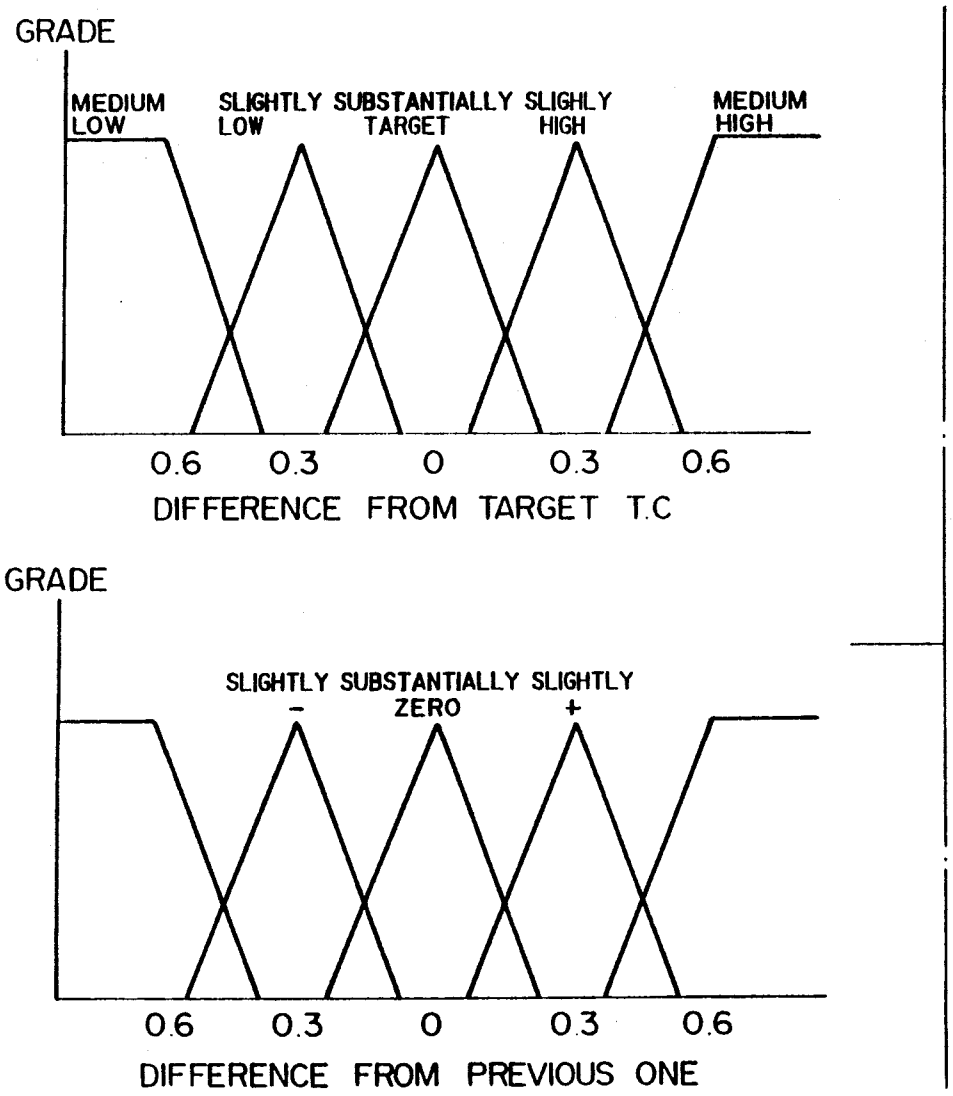
FIG. 14 shows membership functions used in Embodiment 4.
Figure 14B:
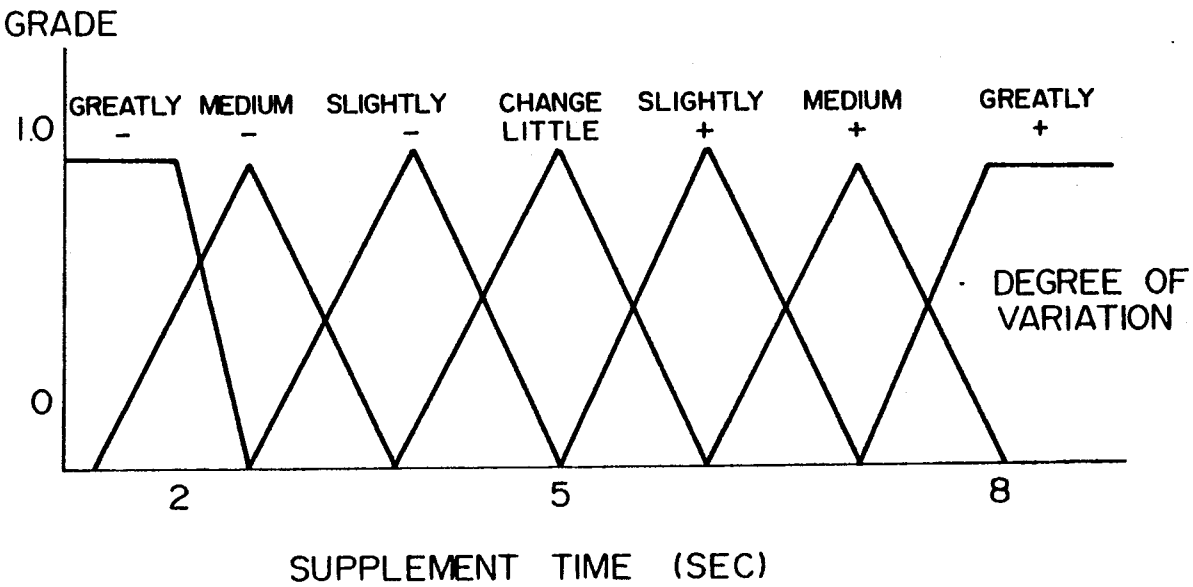
Figure 15B:
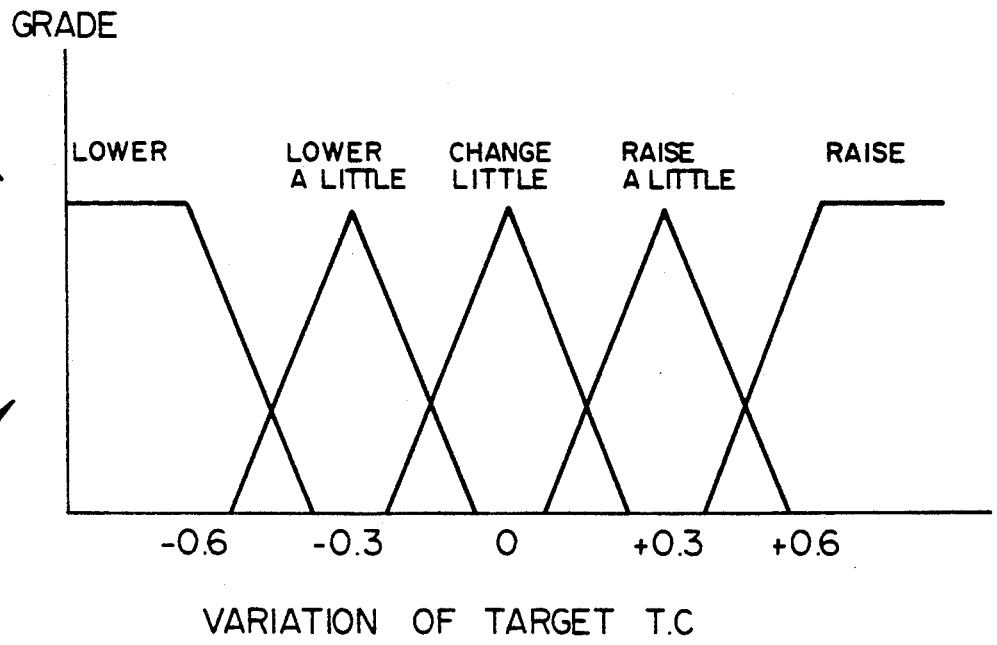
FIG. 15 shows membership functions used in Embodiment 4.

The ten rules listed above are represented by quantized fuzzy variables in terms of membership functions shown in FIGS. 14 and 15 and can be calculated. It is to be noted that the above ten rules are only illustrative and may be replaced with a greater number of rules for achieving more delicate control. The gist is that the design matches a particular control system. For the estimation in the former half of each rule, the degree of conformity of the former half to the inputs is determined by producing MAX of the inputs and the variables of the former half, as usual. Then, MIN of the variables of the latter half and the degree of conformity of the former half is determined as a conclusion of the rule. The conclusion is determined with all of the given rules, and then MAX of all of the conclusions is produced to obtain the final result of estimation, i.e., the variation of target toner concentration (ΔTC) and a supplement time necessary for a required amount of toner to be supplied.

In FIG. 14, assume that the toner concentration is 1.5% which is deviated from a target concentration of 2% , and it differs from the previous concentration by −0.5%. Then, the required toner supplement time is 7 seconds. In FIG. 15, a target variation of toner concentration (ΔTC) can be obtained with $V_{SP}/V_{SG}$ by a similar calculation.

Using the toner sensor 129 constantly operable, the above method maintains the toner concentration at predetermined one and changes the target toner concentration only when the image is stable. Hence, accurate image density control is realized. The accuracy is higher than conventional one even when the number of times that the P sensor pattern is formed is reduced to one-half or to one-third.

While the embodiment controls the toner concentration to a predetermined value by the fuzzy controller 234, it may simply effect ON/OFF control such that the concentration coincides with the output of the fuzzy controller 237.

Embodiment 5

Figure 16:
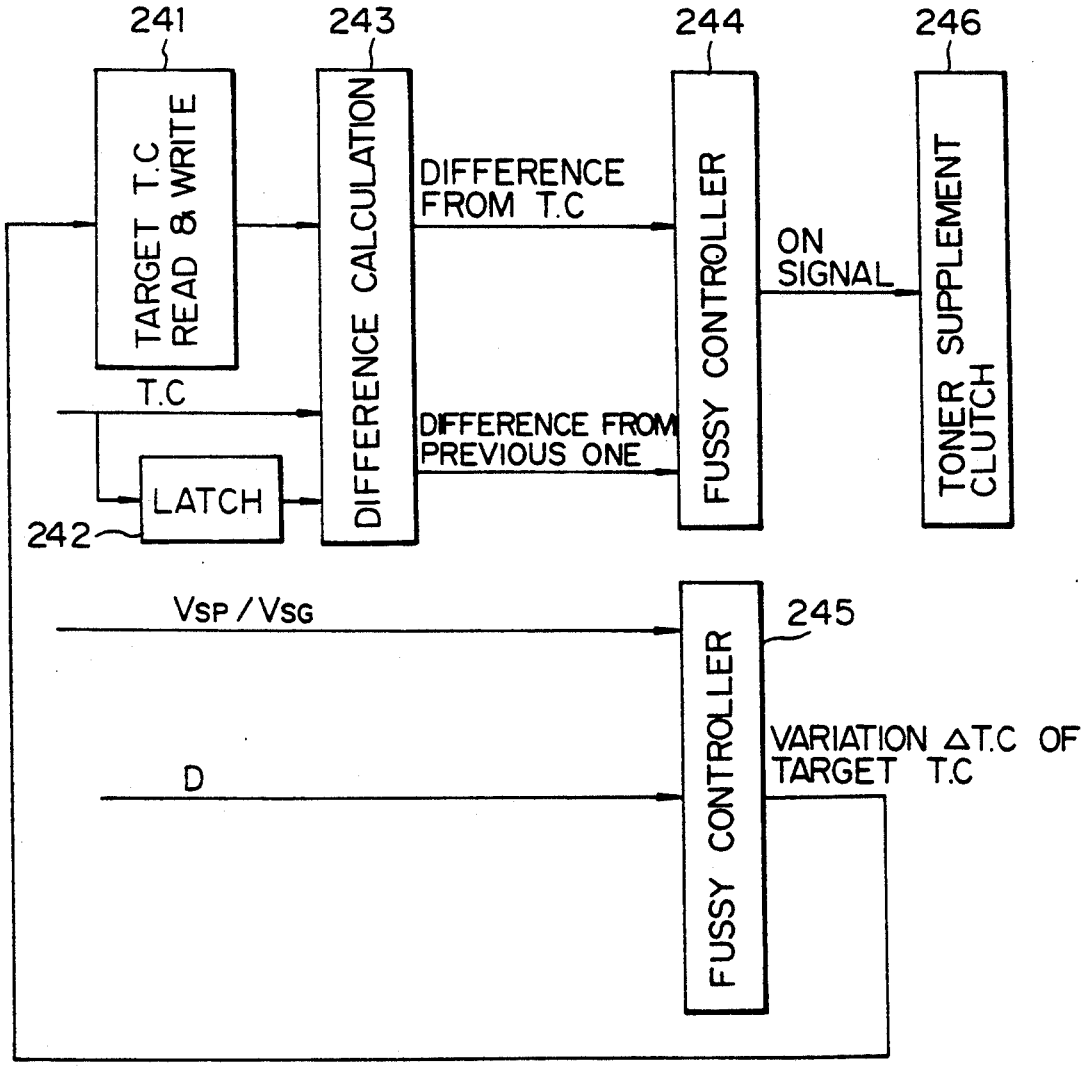
FIG. 16 is a block diagram schematically showing a control system of Embodiment 5.

FIG. 16 shows a control system representative of a fifth embodiment of the present invention. This embodiment is also practicable with the image forming apparatus described in relation to Embodiment 4.

As shown, a difference between the current toner concentration and the target concentration and a difference between the current toner concentration and the previous concentration are applied to a fuzzy controller 244 via a target TC read and write section 241, a latch 242, and difference calculation 243. In response, the fuzzy controller 244 estimates an amount of toner supplement (here supplement time) matching them so as to control a toner supplement clutch 246.

On the other hand, $V_{SP}/V_{SG}$ and a difference D between the toner concentration at the time of pattern formation and the target concentration are applied to a fuzzy controller 245. In response, the fuzzy controller 245 produces a variation (ΔTC) of target toner concentration matching the inputs. The variation (ΔTC) from the fuzzy controller 245 is stored the target TC read and write section 241 until new inputs arrive. In this manner, the output of the fuzzy controller 245 is a variation (ΔTC) of target toner concentration and not an absolute amount. This embodiment, therefore, is capable of coping even with a change in the output characteristic of the toner sensor due to aging.

Generally, the speed of fuzzy calculation depends on the ratio of the multiples of the input steps of input factors. In light of this, in this embodiment, the calculation block is divided on the basis of the input timings of the estimation input data, and the output of the block having a longer timing period is latched until the next inputs arrive while the latched value is fed to the other block having a shorter timing period. This is successful in enhancing rapid processing and, therefore, making the embodiment adaptive even to high speed machines.

In the illustrative embodiment, the target image density is represented by $V_{SP}/V_{SG}$. This, coupled with the fact that a difference D between the toner concentration at the time of pattern formation and the target concentration is taken into account, allows the target concentration to be adequately changed even when the image density is not stable. Further, using the difference between the actual concentration and the target concentration and the history of the concentration as data, the embodiment can estimate a future concentration and, therefore, change the amount of toner supplement beforehand so as to set up a desired toner concentration at all times.

Figures 17, 17A:
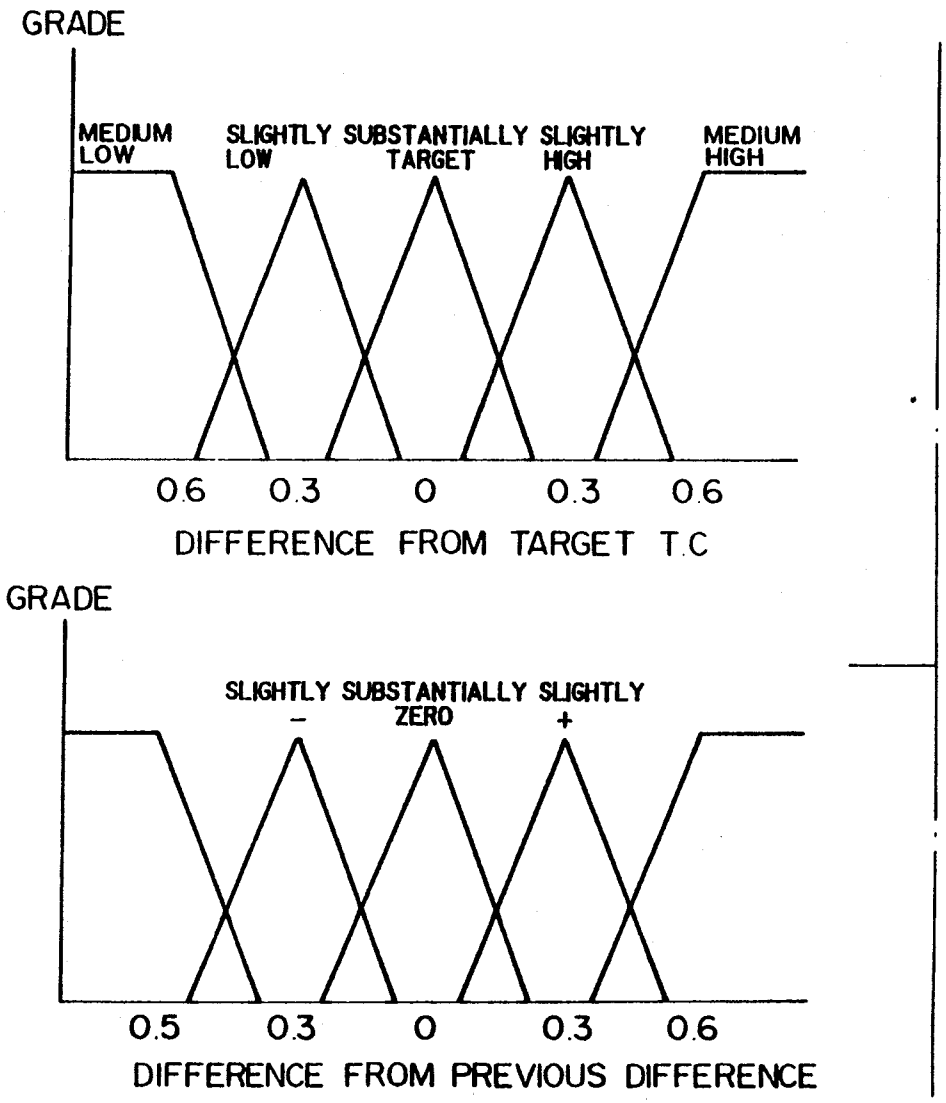
FIG. 17 shows membership functions used in Embodiment 5.
Figure 17B:
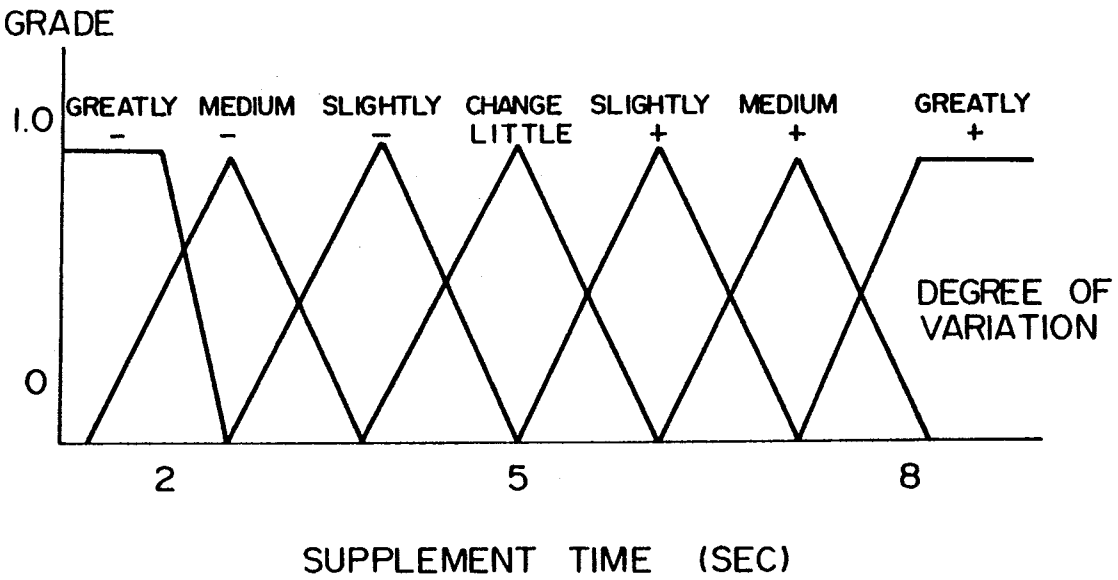
Figure 18B:
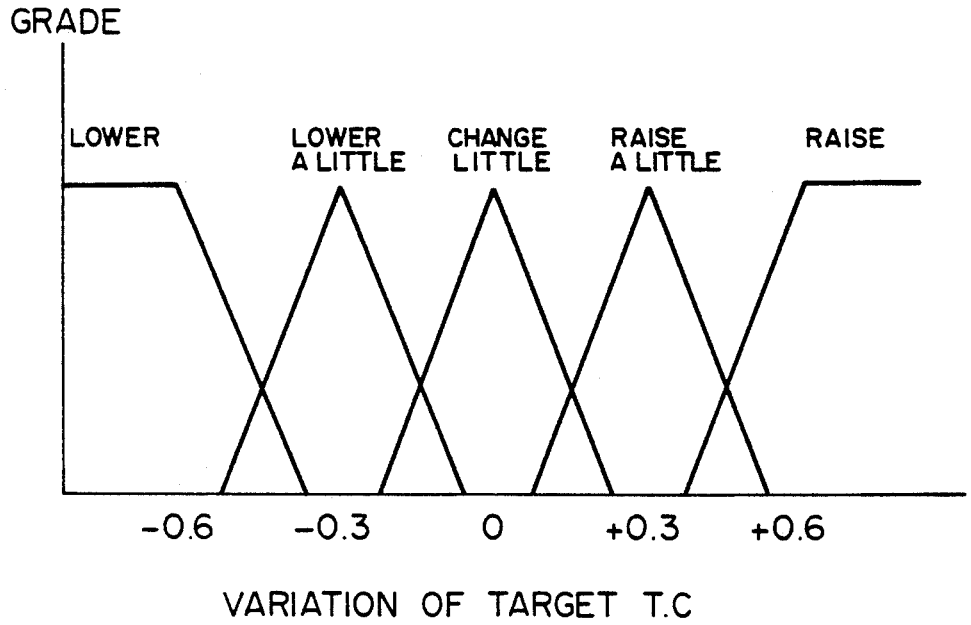
FIG. 18 shows membership functions used in Embodiment 5.

The control rules for fuzzy estimation and the calculating method of this embodiment are essentially the same as those of Embodiment 4, except for the rules for estimating a variation of target concentration. These rules are listed in Table 4 below. FIGS. 17 and 18 show membership functions particular to this embodiment.

TABLE 4

| | |
|---|---|
| Rule 1 | IF VSP/VSG is slightly lower than target and difference between current TC and target TC is slightly small, lower target TC. |
| Rule 2 | If VSP/VSG is slightly lower than target and difference between current TC and target TC is substantially target, lower target TC a little |
| Rule 3 | If VSP/VSG is slightly lower than target and difference between current TC and target TC is slightly high, change target TC little |
| Rule 4 | If VSP/VSG is substantially target and difference between current TC and target TC is slightly small, lower target TC a little. |
| Rule 5 | If VSP/VSG is substantially target and difference between current TC and target TC is substantially target, change target TC little |
| Rule 6 | If VSP/VSG is substantially target and difference between current TC and target TC is slightly great, raise target TC a little. |
| Rule 7 | If VSP/VSG is slightly higher than target and difference between current TC and target TC is slightly small, change target TC little |
| Rule 8 | If VSP/VSG is slightly higher than target and difference between current TC and target TC is |

TABLE 4-continued

| | |
|---|---|
| | substantially target, raise target TC a little |
| Rule 9 . . . | If VSP/VSG is slightly higher than target and difference between current TC and target TC is slightly great, raise target TC. |

With the above method, it is possible to determine an adequate target toner concentration and control image density therewith in various environment, i.e., even when the toner fails to follow the target TC or overshoots beyond the target TC.

Embodiment 6

Figure 19:
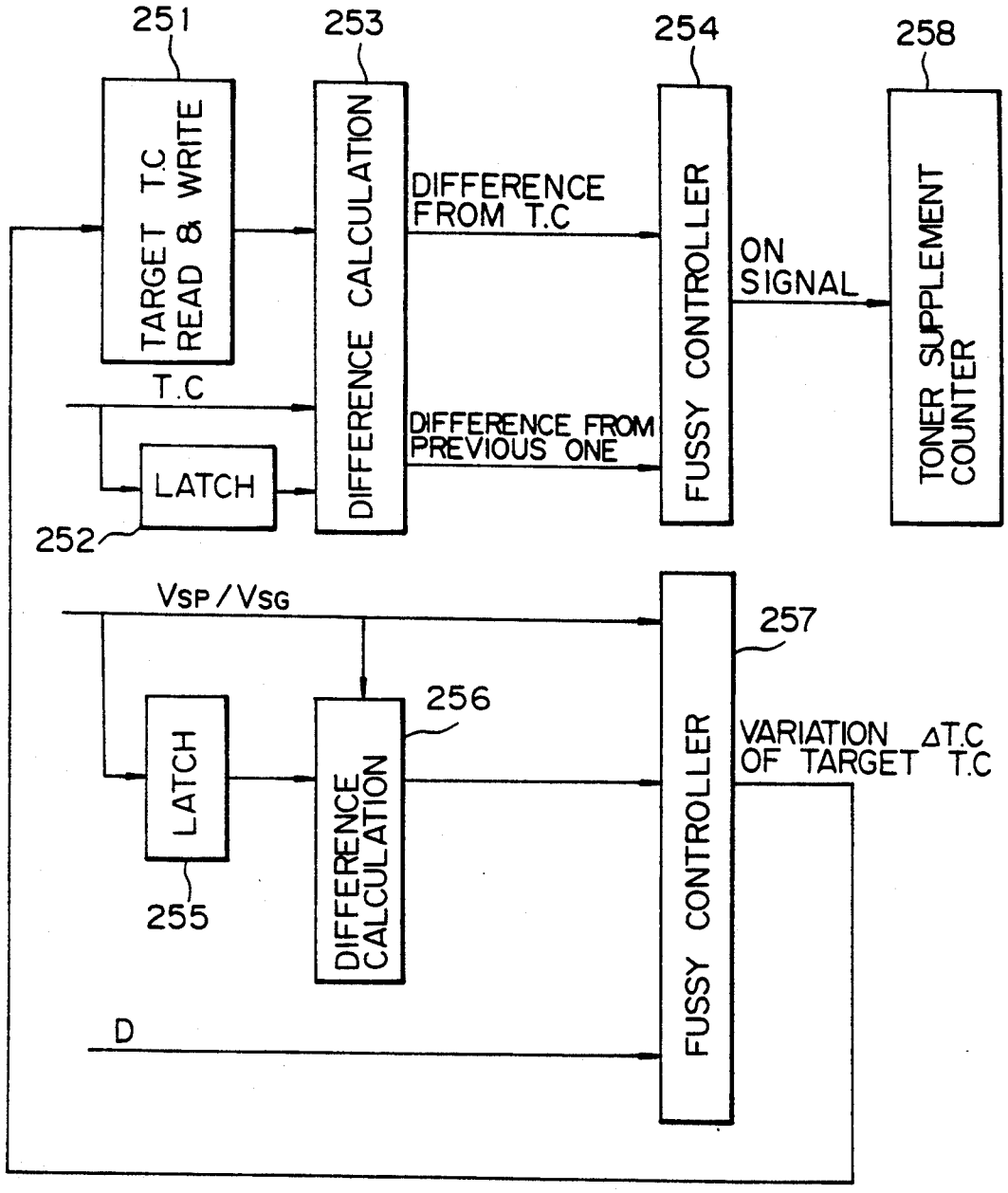
FIG. 19 is a block diagram schematically showing a control system of Embodiment 6.

FIG. 19 shows a control system representative of a sixth embodiment of the present invention. This embodiment is the combination of Embodiments 4 and 5 described above and is practicable with the image forming apparatus of Embodiment 4. The control rules and calculating method of this embodiment are similar to those of Embodiments 4 and 5.

As shown in FIG. 19, a difference between the current toner concentration and the target concentration and a difference between the current concentration and the previous concentration are applied to a fuzzy controller 254 via a target TC read and write section 251, a latch 252, and a difference calculation 253. In response, the fuzzy controller 254 estimates an amount of toner supplement (here, supplement time) to thereby control a toner supply clutch 258. On the other hand, a difference between the current $V_{SP}/V_{SG}$ and the target $V_{SP}/V_{SG}$ and a difference between the current and previous $V_{SP}/V_{SG}$s are applied to a fuzzy controller 257. Also applied to the fuzzy controller 257 is a difference D between the toner concentration at the time of pattern formation and the target concentration. Then, the fuzzy controller 257 changes the target variation (ΔTC) on the basis of the input values and stores the changed variation in the target TC read and write section 251 until new inputs arrive.

Figures 20, 20A:
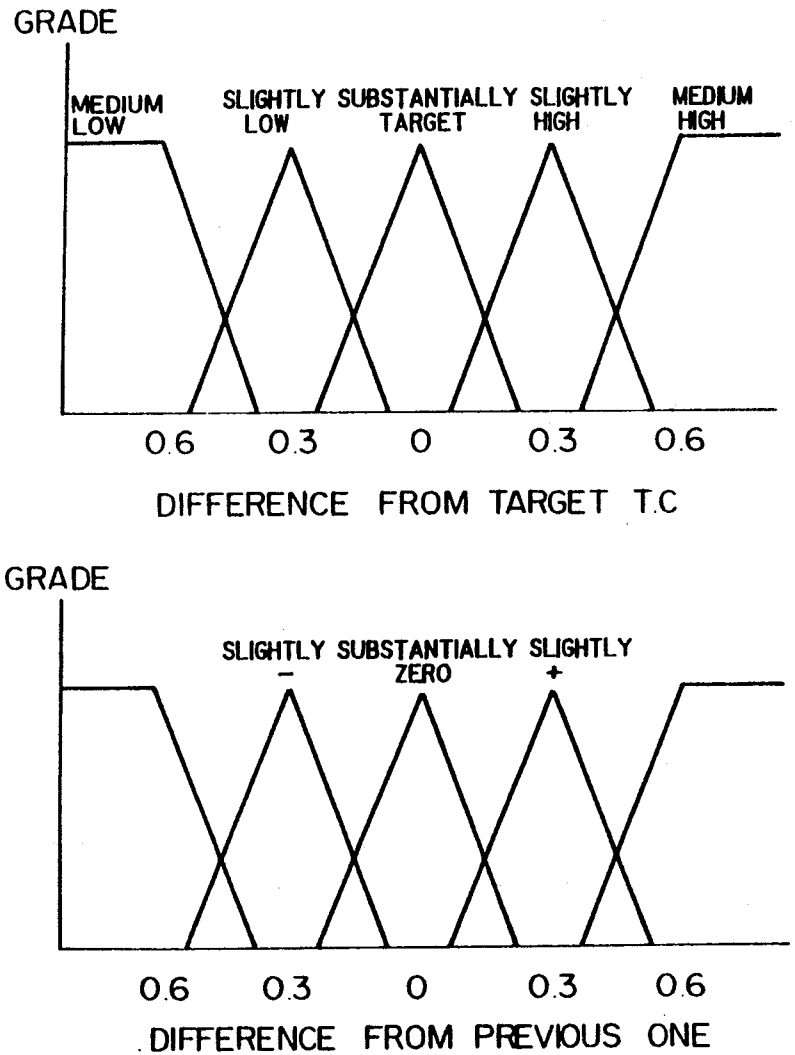
FIG. 20 shows membership functions used in Embodiment 6.
Figure 20B:
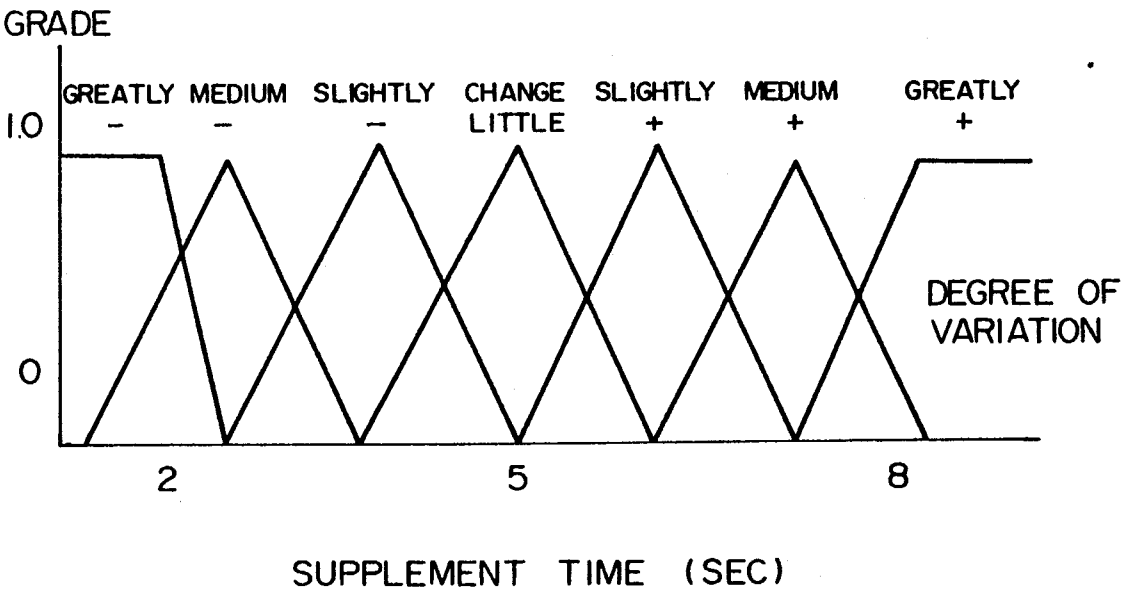
Figures 21, 21A:
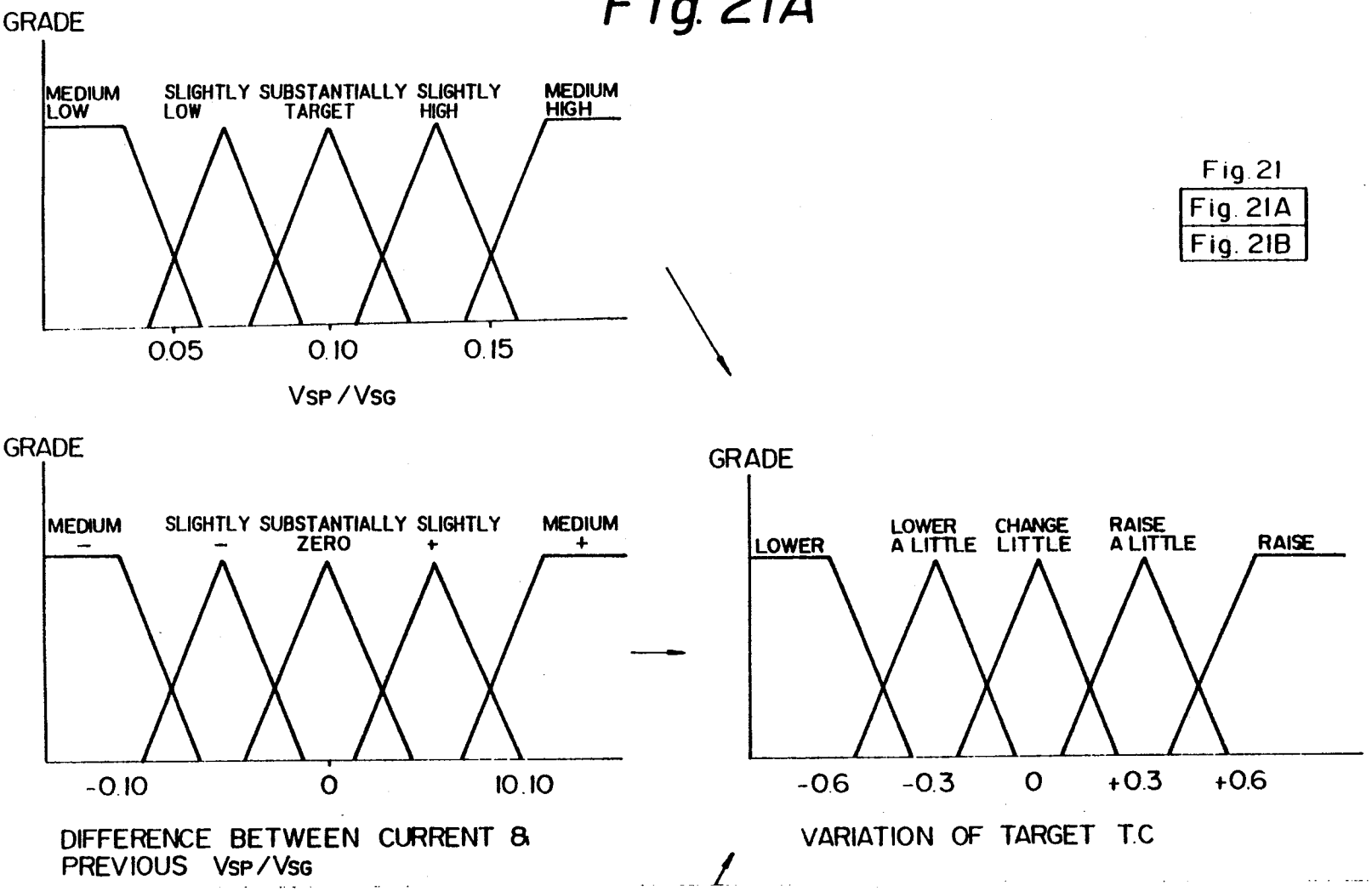
FIG. 21 shows membership functions used in Embodiment 6.
Figure 21B:
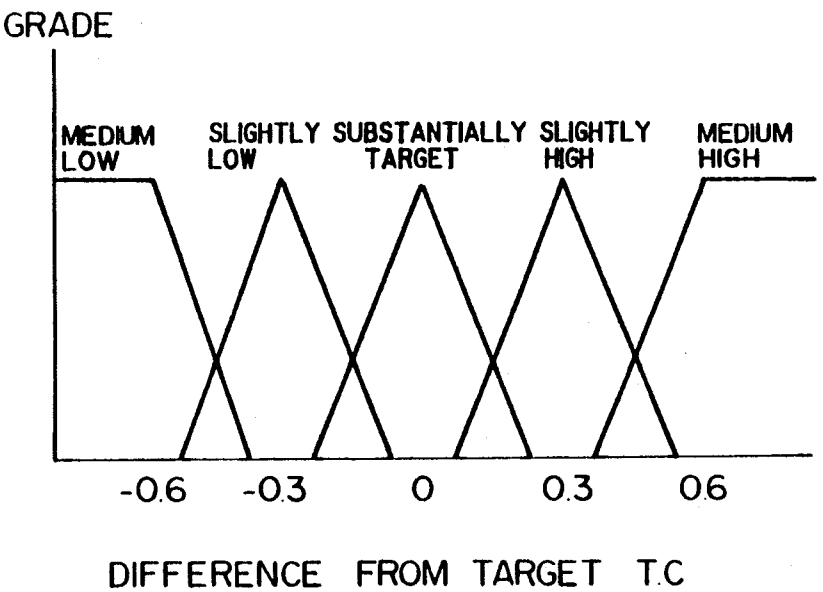
Figure 22A:
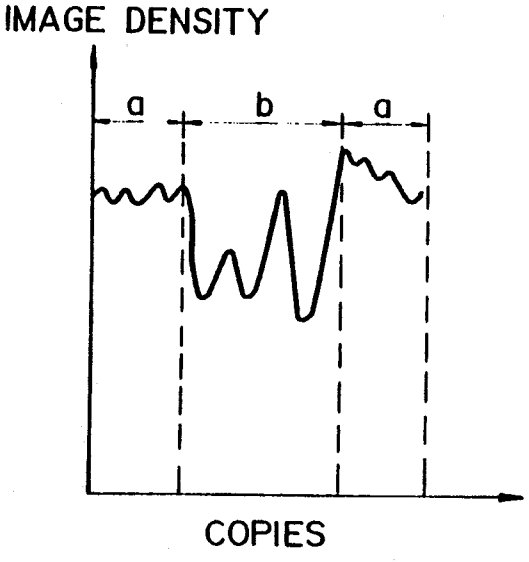
Fig. 22A (PRIOR ART)
FIG. 22 are plots representative of toner supplement control of a conventional method and that of Embodiment 6.
Figure 22B:
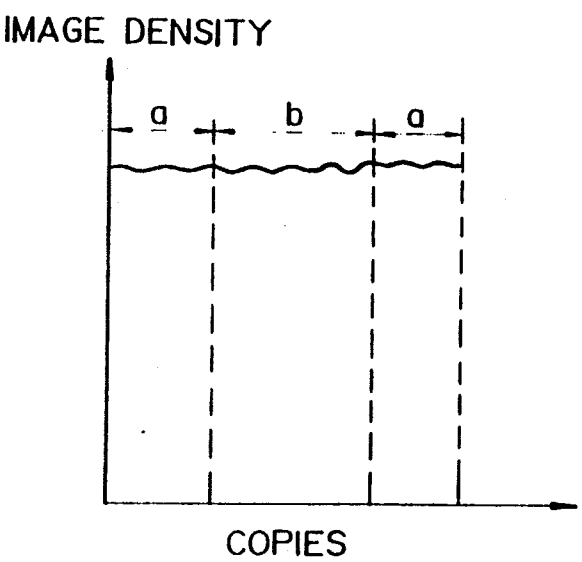

FIGS. 20 and 21 show plots useful for understanding the advantage of the toner supply control of the embodiment over the conventional one which forms a pattern for control once per one to ten copies. As shown, with the embodiment, a stable image density is insured even when the continuous reproduction of documents of A4 size and having an image area of 6% is immediately followed by the continuous reproduction of documents of A4 size and having an image area of 60%. Stated another way, the embodiment is capable of controlling the image density, i.e., toner supplement with unprecedented accuracy in matching relation to various kinds of document areas.

With the above construction, the illustrative embodiment can control image density with accuracy with no regard to the environment and the kind of documents while making most of the advantages of Embodiments 4 and 5.

In summary, it will be seen that the present invention provides an image forming method which sharply responds to a change in environment due to aging and a change in the kind of documents to thereby insure stable image density, compared to a conventional method relaying on an optical sensor or a toner sensor. The method of the invention reduces, without degrading control accuracy, the number of times that a pattern meant for an optical sensor should be formed. This is successful in reducing wasteful toner consumption, the load on a cleaning unit, the fall of copying speed, etc. Moreover, a target image density can be maintained even when a great amount of toner is consumed and a great amount of toner should be supplemented, e.g., when black solid images are continuously reproduced. In addition, accurate control is facilitated even when time available for control is severely limited.

Various modifications will become possible for those skilled in the art after receiving the teachings of the present disclosure without departing from the scope thereof.

What is claimed is:

1. In an image forming method using an electrophotographic process, an estimated amount of toner to be supplemented for maintaining a desired image density is estimated in response to input data which are a ratio of reflection densities produced by an optical sensor responsive to a pattern for control, and an estimated toner consumption signal; and wherein toner supplement control is executed based on said estimated amount of toner to be supplemented.

2. A method as claimed in claim 1, wherein a particular calculation block is assigned to each of the input data each having a particular input timing, an output of one calculation block having longer timing period is held until next input data arrive, and said output is used as input data together with an output of the other calculation block having a shorter timing period.

3. A method as claimed in claim 1, wherein a scale of output functions to be used for the estimation of the amount of toner to be supplemented is changed on the basis of an outputted size of papers.

4. In an image forming method using an electrophotographic process, an estimated amount of toner to be supplemented for maintaining a desired image density is estimated in response to input data which are a ratio of reflection densities produced by an optical sensor responsive to a pattern for control, history data of said ratio, and an estimated toner consumption signal; and wherein toner supplement control is executed based on said estimated amount of toner to be supplemented.

5. A method as claimed in claim 4, wherein a particular calculation block is assigned to each of the input data each having a particular input timing, an output of one calculation block having a longer timing period is held until next input data arrive, and said output is used as input data together with an output of the other calculation block having a shorter timing period.

6. A method as claimed in claim 4, wherein a scale of output functions to be used for the estimation of the amount of toner to be supplement is changed based on an outputted size of papers.

7. In an image forming method using an electrophotographic process, an amount of toner to be supplemented for maintaining a target toner concentration is estimated in response to input data which are a ratio of reflection densities produced by an optical sensor responsive to a pattern for control, a difference between a toner concentration at a time when the pattern is formed and a previous target toner concentration, and history data of at least one of said ratio and said difference; and wherein toner supplement control for maintaining the target toner concentration is executed based on a difference between the toner concentration and the target toner concentration.

8. A method as claimed in claim 7, wherein the estimation of the target toner and the estimation of the amount of toner to be supplemented are each effected by a particular estimation block and at a particular sensing timing and calculation timing.

9. A method as claimed in claim 7, wherein the target toner concentration is represented by a variation form a current toner concentration.

10. In an image forming method which controls supplement of a toner in response to an output of a toner sensor, an estimated target toner concentration is totally estimated in response to a ratio of reflection densities produced by an optical sensor responsive to a pattern for control, and history data of said ratio, and a target toner concentration is set or changed based on the estimated target toner concentration.

11. A method as claimed in claim 10, wherein the estimation of the target toner concentration and an estimation of an amount of toner to be supplemented are each effected by a particular estimation block and at a particular sensing timing and calculation timing.

12. A method as claimed in claim 10, wherein the target toner concentration is represented by a variation from a current toner concentration.

13. In an image forming method which controls supplement of a toner in response to an output of a toner sensor, an estimated target toner concentration is totally estimated in a response to a ratio of reflection densities produced by an optical sensor responsive to a pattern for control and a difference between a toner concentration at a time when the pattern for control is formed and a previous target toner concentration, and a target toner concentration is set or changed based on the estimated target toner concentration.

14. A method as claimed in claim 13, wherein the estimation of target toner concentration and an estimation of an amount of toner to be supplemented are each effected by a particular estimation block and at a particular sensing timing and calculation timing.

15. A method as claimed in claim 13, wherein the target toner concentration is represented by a variation from a current toner concentration.

16. The method of claim 1, wherein said estimated toner consumption signal is based on at least one of image forming, image reading and image processing information.

17. The method of claim 7, wherein said estimated toner consumption signal is based on at least one of image forming, image reading and image processing information.

* * * * *